US010822194B1

(12) United States Patent
Hegler

(10) Patent No.: US 10,822,194 B1
(45) Date of Patent: Nov. 3, 2020

(54) EXPANDABLE COIL DEPLOYMENT SYSTEM FOR DRUM ASSEMBLY AND METHOD OF USING SAME

(71) Applicant: TRINITY BAY EQUIPMENT HOLDINGS, LLC, Houston, TX (US)

(72) Inventor: Matthew Allen Hegler, Kingwood, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

(21) Appl. No.: 16/720,856

(22) Filed: Dec. 19, 2019

(51) Int. Cl.
*B65H 75/40* (2006.01)
*B65H 75/44* (2006.01)

(52) U.S. Cl.
CPC ..... *B65H 75/403* (2013.01); *B65H 75/4402* (2013.01); *B65H 75/4478* (2013.01)

(58) Field of Classification Search
CPC ..... B65H 75/403; B65H 75/4478; B65H 75/4402
See application file for complete search history.

(56) References Cited

U.S. PATENT DOCUMENTS 1,890,361 A 12/1932 Beattie
2,382,968 A * 8/1945 Berman ..... B65H 49/305 242/401
2,562,095 A * 7/1951 Hengst ..... A01K 97/16 242/401
2,974,972 A 3/1961 Hassell
3,106,358 A * 10/1963 Lehmann ..... B65H 75/28 242/527
3,269,744 A 8/1966 Dobson
3,544,127 A 12/1970 Dobson
3,738,284 A 6/1973 Atsuta et al.
3,764,031 A * 10/1973 Parsen ..... B60P 3/035 414/485

(Continued)

FOREIGN PATENT DOCUMENTS

CN 204802737 11/2015
CN 107522012 12/2017

(Continued)

OTHER PUBLICATIONS

Amazon.com; Big Red TR1147 Torin Dual Position Hydraulic Forklift Service/Floor Jack, 5 ton Capacity; printed May 8, 2020; 8 pages; https://www.amazon.com/Torin-Hydraulic-Forklift-Floor-Capacity/dp/B00026Z3BS.

(Continued)

*Primary Examiner* — William A. Rivera
(74) *Attorney, Agent, or Firm* — Greenberg Traurig, LLP; Dwayne L. Mason; Ira Hatton

(57) ABSTRACT

A coil deployment system and one or more methods of manipulating a coil deployment system, is provided. The coil deployment system has a trailer frame of one or more frame components including a pair of support brackets, a first pair of lower support arms, a second pair of lower support arms, a first pair of upper support arms, and a second pair of upper support arms. The trailer frame is adjustable such that the width and height of the trailer can be adjusted to manipulate and accommodate various sizes of coil drums of spoolable pipe deploy, collect, transport or store the spoolable pipe.

20 Claims, 11 Drawing Sheets

(56) References Cited

U.S. PATENT DOCUMENTS

| | | | | | |
|---|---|---|---|---|---|
| 3,920,194 | A * | 11/1975 | Parsen | B65H 49/321 | 242/591 |
| 4,296,891 | A | 10/1981 | Sidaway et al. | | |
| 4,454,999 | A * | 6/1984 | Woodruff | B65H 49/34 | 242/388.7 |
| 4,655,670 | A | 4/1987 | Hogberg et al. | | |
| 4,711,407 | A | 12/1987 | Boon | | |
| 4,746,078 | A * | 5/1988 | Setzke | B65H 49/321 | 242/129.6 |
| 5,333,809 | A | 8/1994 | Berry, III et al. | | |
| 5,598,866 | A * | 2/1997 | Nelson | B65H 75/425 | 137/355.12 |
| 6,284,076 | B1 | 9/2001 | Mattson | | |
| 7,077,368 | B1 | 7/2006 | Karoly | | |
| 7,588,207 | B1 * | 9/2009 | Malkin | B65H 49/24 | 242/403 |
| 7,628,350 | B2 * | 12/2009 | Dethier | B65H 75/403 | 242/403 |
| 7,980,804 | B2 | 7/2011 | Snook et al. | | |
| 3,016,303 | A1 | 9/2011 | Ullman et al. | | |
| 8,403,250 | B1 * | 3/2013 | Callahan | B65H 75/403 | 137/355.26 |
| 8,985,496 | B2 * | 3/2015 | Dillinger | B21C 47/30 | 242/577 |
| 9,624,077 | B1 | 4/2017 | Jordan et al. | | |
| 9,718,638 | B2 | 8/2017 | Guiffault et al. | | |
| 10,273,111 | B2 | 4/2019 | Grabowski et al. | | |
| 2008/0014052 | A1 | 1/2008 | Rodriguez | | |
| 2009/0065663 | A1 | 3/2009 | Jordan et al. | | |
| 2011/0220756 | A1 * | 9/2011 | Mosher | B65H 75/403 | 242/476.1 |
| 2017/0245407 | A1 * | 8/2017 | Takanami | H05K 13/0417 | |
| 2018/0155158 | A1 | 6/2018 | Levey | | |
| 2018/0170706 | A1 | 6/2018 | Grabowski et al. | | |
| 2019/0210830 | A1 | 7/2019 | Grabowski et al. | | |

FOREIGN PATENT DOCUMENTS

| | | |
|---|---|---|
| CN | 207090585 | 3/2018 |
| CN | 105692324 | 6/2018 |
| CN | 207497845 | 6/2018 |
| CN | 207792298 | 8/2018 |
| EP | 847882 | 7/2001 |
| FR | 2815658 | 4/2002 |
| FR | 2854102 | 10/2004 |
| FR | 2918654 | 10/2009 |
| IT | 20110011 | 3/2013 |
| JP | S5938176 | 3/1984 |
| JP | H08301581 | 11/1996 |
| JP | H08318703 | 12/1996 |
| JP | 5698437 | 2/2015 |
| RU | 2273587 | 4/2006 |
| WO | 2007/036625 | 4/2007 |
| WO | 2007/085355 | 8/2007 |

OTHER PUBLICATIONS

Alibaba.com; DL036 Scissor Lift Drum Stand from Behind Cable Drum Lifting Jack; printed May 8, 2020; 9 pages; https://www.alibaba.com/product-detail/DL036-Scissor-lift-drum-stands-from_60342716583.html?fullFirstScreen=true.

Redlinestands.com; Norco 8-1/2 Ton Long Reach Air Lift Jack; printed May 8, 2020; 3 pages; https://www.redlinestands.com/catalog/shop-equipment-c-327/automotive-c-327_328/racing-floor-jacks-c-327_328_353/norco-812-ton-long-reach-air-lift-jack-p-2055.

Globalindustrial.com; GKS Perfekt TL6 Tandem Roller Dolly Swivel Plates, Adjustable Width Frame 13,200 lbs. Cap.; prtined May 8, 2020; 6 pages; https://www.globalindustrial.com/p/material-handling/hand-trucks-dollies/dollies-machinery-furniture-slides/tandem-roller-dolly-swivel-plates-adjustable-frame-steer-handle-1.

Amazon.com; Vestil ACE-1624 Adjustable Carpet End Dolly, 1200# Capacity, 16-½" Width × 24" Length × 6-¾" Height, Extended Length 40", Steel, Powdercoat Blue, Poly Casters; printed May 8, 2020; 3 pages; https://www.amazon.com/Vestil-ACE-1624-Adjustable-Capacity-Powdercoat/dp/B010FVLMTQ.

* cited by examiner

EXPANDABLE COIL DEPLOYMENT SYSTEM FOR DRUM ASSEMBLY AND METHOD OF USING SAME

CROSS-REFERENCE TO RELATED APPLICATIONS

None.

FIELD OF THE INVENTION

The embodiments described herein relate to deployment systems and transportation systems for spoolable pipes.

BACKGROUND

Flexible pipe is useful in a myriad of environments, including in the oil and gas industry. Flexible pipe may be durable and operational in harsh operating conditions and can accommodate high pressures and temperatures. Flexible pipe may be packaged into a coil or onto a reel to facilitate transporting and using the pipe.

Coils of pipe may be positioned in an "eye to the side" or "eye to the sky" orientation. When the flexible pipe is coiled and is disposed with its interior channel facing upwards, such that the coil is in a horizontal orientation, then the coils of pipe are referred to as being in an "eye to the sky" orientation. If, instead, the flexible pipe is coiled and disposed such that the interior channel is not facing upwards, such that the coil is in an upright or vertical orientation, then the coils of pipe are referred to as being in an "eye to the side" orientation.

The flexible pipe may be transported as coils or reels to various sites for deployment (also referred to as uncoiling or unspooling). Different types of devices and vehicles are currently used for loading and transporting coils of pipe, but usually extra equipment and human manual labor is also involved in the process of loading or unloading such coils for transportation and/or deployment. Such coils of pipe are often quite large and heavy. Additionally, the equipment used to store, collect, deploy and transport the coils of spoolable pipe is often times bulky and not reasonably able to deploy or collect spoolable pipe in a quick an efficient manner. Accordingly, there exists a need for an improved method and apparatus for loading, unloading, deploying, collecting, transporting and storing coils of pipe, including coils of pipe disposed on coil drums and coil drum assemblies.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a coil deployment system. The coil deployment system can be utilized with various coil drums that have different widths and heights. In one or more embodiments, the coil deployment system includes a coil deployment trailer. In one or more embodiments, the coil deployment trailer includes a first support bracket configured to interlockingly and rotatably receive a first hub shaft of a coil drum. In one or more embodiments, the coil deployment trailer also includes a second support bracket, configured to interlockingly and rotatably receive a second hub shaft of the coil drum, that is spaced apart from the first support bracket. In one or more embodiments, the coil drum is an expandable coil drum assembly. In one or more other embodiments, the coil deployment trailer is configured to manipulate a reel of spoolable pipe wherein the reel includes a first hub shaft and a second hub shaft that are configured to be interlockingly and rotatably engaged by first and second support brackets, respectively. In one or more embodiments, the coil deployment trailer includes a first horizontal support bar including a pair of telescoping extension arms. Each of the pair of telescoping extension arms can include an outer end. In one or more embodiments, the coil deployment trailer also includes a first lower support arm having a first end pivotably connected to the first support bracket, and a second end connected to the horizontal support bar. In one or more embodiments, the coil deployment trailer also includes a second lower support arm having a first end pivotably connected to the second support bracket, and a second end connected to the horizontal support bar. In one or more embodiments, the coil deployment trailer also includes a third lower support arm having a first end, pivotably connected to the first support bracket, and a second end. In one or more embodiments, the coil deployment trailer also includes a fourth lower support arm having a first end, pivotably connected to the second support bracket, and a second end. In one or more embodiments, the width of the coil deployment trailer is adjustable by moving the outer ends of the pair of telescoping extension arms, included in the first horizontal support bar, in an axial direction with respect to one another by slidably adjusting the pair of telescoping extension arms to adjust the length of the horizontal support bar.

In another aspect, embodiments of the present disclosure relate to a coil deployment system. In one or more embodiments, the coil deployment system includes a coil deployment trailer. In one or more embodiments, the coil deployment trailer includes a first set of wheels mounted on each of the first lower support arm and the second lower support arm. In one or more embodiments, the coil deployment trailer also includes a second set of wheels mounted on each of the third lower support arm and fourth lower support arm. In one or more embodiments, each of the first and second set of wheels has an axis generally parallel to the horizontal support bar and is configured to engage a ground surface to provide support and positioning for the coil deployment trailer. In one or more embodiments, the coil deployment trailer also includes a third set of wheels mounted on each of the first lower support arm, between the first set of wheels and the first end of the first lower support arm, and the second lower support arm, between the first set of wheels and the first end of the second lower support arm. In one or more embodiments, the coil deployment trailer also includes a fourth set of wheels mounted on each of the second lower support arm, between the second set of wheels and the first end of the second lower support arm, and the fourth lower support arm, between the second set of wheels and the first end of the fourth lower support arm. In one or more embodiments, each of the first lower support arm, second lower support arm, third lower support arm and fourth lower support arm are of a fixed length and do not include telescoping bars. In one or more embodiments, the height of the trailer is adjustable by moving the first lower support arm, second lower support arm, third lower support arm and fourth lower support arm relative to one to change the angular position of each of the first, second, third and fourth lower support arms with respect to their respective support brackets. In one or more embodiments, each of the first lower support arm, second lower support arm, third lower support arm and fourth lower support arm further comprise a pair of telescoping bars. In one or more embodiments, the height of the trailer is adjustable by moving the first ends and the second ends of each of the first lower support arm, second lower support arm, third lower support arm and fourth lower support arm relative to one another by slidably adjusting the pair of telescoping bars to adjust the length of the first lower support arm, second lower support arm, third lower support arm and fourth lower support arm. In one or more embodiments, each of the third set of wheels and the fourth set of wheels is configured to engage the ground surface and provide support and positioning to the trailer when the height of the trailer is reduced to its fully collapsed position. In one or more embodiments, the third set of wheels has an axis that is generally perpendicular to the axis of the first set of wheels. In one or more embodiments, the fourth set of wheels has an axis that is generally perpendicular to the axis of the second set of wheels.

In one or more embodiments, the coil deployment trailer also includes a first lower support arm having a first end pivotably connected to the first support bracket, and a second end connected to the horizontal support bar. In one or more embodiments, the coil deployment trailer also includes a second lower support arm having a first end pivotably connected to the second support bracket, and a second end connected to the horizontal support bar. In one or more embodiments, the coil deployment trailer also includes a third lower support arm having a first end, pivotably connected to the first support bracket, and a second end. In one or more embodiments, the coil deployment trailer also includes a fourth lower support arm having a first end, pivotably connected to the second support bracket, and a second end. In one or more embodiments, the coil deployment trailer also includes a first hydraulic cylinder disposed between the first lower support arm and the third lower support arm. In one or more embodiments, the coil deployment trailer also includes a second hydraulic cylinder disposed between the second lower support arm and the fourth lower support arm. In one or more embodiments, the height of the coil deployment trailer is adjustable by actuating the first and second hydraulic cylinders to move the first lower support arm with respect to the third lower support arm and the second lower support arm with respect to the fourth lower support arm such that the angular positions of the first, second, third and fourth lower support arms with respect to the support brackets to which they are attached, via their respective pivotable connections, is changed.

In one or more embodiments, the coil deployment system also includes a coil deployment trailer. In one or more embodiments, the coil deployment trailer includes a second horizontal support bar that comprises a pair of telescoping extension arms. In one or more embodiments, each of the pair of telescoping extension arms includes an outer end. In one or more embodiments, the width of the trailer is adjustable by moving the outer ends of the pair of telescoping extension arms included in the second horizontal support bar in an axial direction with respect to one another and in concert with the pair of telescoping extension arms included in the first horizontal support bar. In one or more embodiments, the coil deployment trailer also includes a coupling assembly support bar including a pair of telescoping arms. In one or more embodiments, each of the telescoping arms includes an outer end. In one or more embodiments, the coil deployment trailer also includes a first upper support arm having a first end, connected to the coupling assembly support bar, and a second end pivotably connected to the first support bracket. In one or more embodiments, the coil deployment trailer also includes a second upper support arm having a first end, connected to the coupling assembly support bar, and a second end pivotably connected to the second support bracket. In one or more embodiments, the width of the trailer is adjustable by slidably adjusting the pair of telescoping arms, included in the coupling assembly support bar, with respect to one another in response to adjusting the length of the horizontal support bar. In one or more embodiments, the coil deployment trailer also includes a first hydraulic cylinder disposed between the first upper support arm and the third upper support arm. In one or more embodiments, the coil deployment trailer also includes a second hydraulic cylinder disposed between the second upper support arm and the fourth upper support arm. In one or more embodiments, the height of the coil deployment trailer is adjustable by actuating the first and second hydraulic cylinders to move the first upper support arm with respect to the third upper support arm and the second upper support arm with respect to the fourth upper support arm such that the angular positions of the first, second, third and fourth upper support arms with respect to the support brackets to which they are attached, via their respective pivotable connections, is changed.

In one or more embodiments, the coil deployment trailer also includes a pipe re-spooler mounted to the first upper support arm. In one or more embodiments, the pipe re-spooler also includes a first re-spooler bracket mounted to the first upper support arm. In one or more embodiments, the pipe re-spooler also includes a second re-spooler bracket mounted to the second upper support bar. In one or more embodiments, the pipe re-spooler also includes a first substantially cylindrical member having a first end and a second end. In one or more embodiments, the first substantially cylindrical member extends between and is rotatably mounted to the first re-spooler bracket at the first end and the second re-spooler bracket at the second end. In one or more embodiments, the first substantially cylindrical member is configured to engage a coil of spoolable pipe to assist in at least one of the deployment and collection of the spoolable pipe. In one or more embodiments, the pipe re-spooler also includes a second substantially cylindrical member having a first end and a second end. In one or more embodiments, the second substantially cylindrical member extends between and is rotatably mounted to the first re-spooler bracket at the first end and the second re-spooler bracket at the second end. In one or more embodiments, the second substantially cylindrical member is configured to engage the coil of spoolable pipe to assist in at least one of the deployment and collection of the spoolable pipe. In one or more embodiments, the first and second substantially cylindrical members each further comprises a pair of telescoping bars. In one or more embodiments, the length of the first and second substantially cylindrical members is adjustable by slidably adjusting the pairs of telescoping extension bars, included in the first and second substantially cylindrical members, with respect to one another in response to adjusting the length of the horizontal support bar. In one or more embodiments, the length of the coupling assembly support bar and the length of the pipe re-spooler is automatically adjusted when the length of the horizontal support bar is adjusted.

In another aspect, embodiments of the present disclosure relate to a coil deployment system. In one or more embodiments, the coil deployment system also includes a coil deployment trailer. In one or more embodiments, the coil deployment trailer includes a horizontal containment bar including a pair of telescoping bars. In one or more embodiments, each of the telescoping bars includes an outer end. In one or more embodiments, the coil deployment trailer also includes a third upper support arm having a first end, connected to the horizontal containment bar, and a second end pivotably connected to the first support bracket. In one or more embodiments, the coil deployment trailer also includes a fourth upper support arm having a first end, connected to the horizontal containment bar, and a second end pivotably connected to the second support bracket. In one or more embodiments, the length of the horizontal containment bar is adjustable by moving the outer ends of the pair of telescoping bars with respect to one another by slidably adjusting the pair of telescoping bars included in the horizontal containment bar in response to adjusting the length of the horizontal support bar. In one or more embodiments, the length of the horizontal containment bar is adjustable by slidably adjusting the pair of telescoping bars included in the horizontal containment bar in response to adjusting the length of the horizontal support bar. In one or more embodiments, each of the first lower support arm, second lower support arm, third lower support arm and fourth lower support arm each further includes a pair of telescoping bars. In one or more embodiments, the height of the trailer is adjustable by slidably adjusting the pairs of telescoping bars to adjust the length of each of the first lower support arm, second lower support arm, third lower support arm and fourth lower support arm. In one or more embodiments, the height of the trailer is adjustable by adjusting the distance between the first end and the second end of each of the first lower support arm, second lower support arm, third lower support arm and fourth lower support arm by slidably adjusting the pairs of telescoping bars to adjust the length of each of the first lower support arm, second lower support arm, third lower support arm and fourth lower support arm.

In another aspect, embodiments of the present disclosure relate to a coil deployment system. In one or more embodiments, the coil deployment system also includes a coil deployment trailer. In one or more embodiments, the coil deployment trailer includes a first lower support arm, second lower support arm, third lower support arm and fourth lower support arm. In one or more embodiments, each of the first lower support arm, second lower support arm, third lower support arm and fourth lower support arm each further includes a pair of telescoping bars. In one or more embodiments, each of the pairs of telescoping bars further includes one or more actuators that are configured to adjust the length of each of the first lower support arm, second lower support arm, third lower support arm and fourth lower support arm. In one or more embodiments, the one or more actuators include at least one of a hydraulic actuator, a pneumatic actuator, an electro-magnetic actuator, and an electrical actuator. In one or more embodiments, the coil deployment system also includes a controller that is operable to automatically adjust the width of the trailer frame. In one or more embodiments, the coil deployment system also includes a controller that is operable to automatically adjust the height of the trailer frame.

In another aspect, embodiments of the present disclosure relate to one or more methods of manipulating a coil of spoolable pipe, including the deploying, collecting, transporting or storing a coil of spoolable pipe using a coil deployment system. In one or more embodiments, one or more methods include providing a coil drum. In one or more embodiments, a coil drum includes a first hub disposed at the first end of the support bar and a second hub disposed at the second end of the support bar. In one or more embodiments, the first hub comprises a first hub shaft and the second hub comprises a second hub shaft.

In another aspect, embodiments of the present disclosure relate to one or more methods of manipulating, deploying, collecting or storing a coil of spoolable pipe using a coil deployment system. In one or more embodiments, one or more methods include a coil deployment trailer. In one or more embodiments, the coil deployment trailer includes a first support bracket configured to interlockingly and rotatably receive the first hub shaft of the coil drum. In one or more embodiments, the coil deployment trailer includes a second support bracket, configured to interlockingly and rotatably receive the second hub shaft of the coil drum, that is spaced apart from the first support bracket. In one or more embodiments, the coil deployment trailer includes a horizontal support bar including a pair of telescoping extension arms. In one or more embodiments, the coil deployment trailer includes a first lower support arm having a first end pivotably connected to the first support bracket, and a second end connected to the horizontal support bar. In one or more embodiments, the first lower support arm further includes interconnected telescoping arms. In one or more embodiments, the coil deployment trailer includes a second lower support arm having a first end pivotably connected to the second support bracket. In one or more embodiments, the coil deployment trailer includes a second end connected to the horizontal support bar. In one or more embodiments, the second lower support arm further includes interconnected telescoping arms. In one or more embodiments, the coil deployment trailer includes a third lower support arm having a first end, pivotably connected to the first support bracket, and a second end. In one or more embodiments, the third lower support arm further includes interconnected telescoping arms. In one or more embodiments, the coil deployment trailer includes a fourth lower support arm having a first end, pivotably connected to the second support bracket, and a second end. In one or more embodiments, the fourth lower support arm further includes interconnected telescoping arms. In one or more embodiments, the space between the first, second, third and fourth lower support arms defines an interior space of the trailer frame. In one or more embodiments, one or more methods include positioning the coil drum of spoolable pipe within the interior region of the trailer frame, aligning the first hub with the first support bracket. In one or more embodiments, one or more methods include aligning the second hub with the second support bracket. In one or more embodiments, one or more methods include extending the pair of telescoping arms included in the first, second, third and fourth support arms to raise the trailer frame such that the first hub engages the first support bracket and the second hub engages the second support bracket such that the coil drum is secured to the trailer frame. In one or more embodiments, one or more methods include determining the width of the coil drum. In one or more embodiments, one or more methods include extending the pair of telescoping extension arms included in the horizontal support bar to adjust the width of the trailer frame to a suitable width to accommodate the coil drum of spoolable pipe.

In another aspect, embodiments of the present disclosure relate to one or more methods of manipulating, deploying, collecting or storing a coil of spoolable pipe using a coil deployment system. In one or more embodiments, one or more methods include a coil deployment trailer. In one or more embodiments, the coil deployment trailer includes a first set of wheels mounted on each of the first lower support arm and the second lower support arm. In one or more embodiments, the coil deployment trailer includes a second set of wheels mounted on each of the third lower support arm and fourth lower support arm. In one or more embodiments, the coil deployment trailer includes a third set of wheels mounted on each of the first lower support arm, between the first set of wheels and the first end of the first lower support arm, and the second lower support arm, between the first set of wheels and the first end of the second lower support arm. In one or more embodiments, the coil deployment trailer includes a fourth set of wheels mounted on each of the second lower support arm, between the second set of wheels and the first end of the second lower support arm, and the fourth lower support arm, between the second set of wheels and the first end of the fourth lower support arm. In one or more embodiments, each of the first and second set of wheels has an axis generally parallel to the horizontal support bar. In one or more embodiments, each of the third and fourth set of wheels has an axis generally perpendicular to the first and second set of wheels. In one or more embodiments, one or more methods include using the first, second, third and fourth set of wheels to maneuver the trailer frame to position the coil drum of spoolable pipe within the interior space of the trailer frame.

Other aspects and advantages of the claimed subject matter will be apparent from the following description and the appended claims.

DETAILED DESCRIPTION

Figure 1:
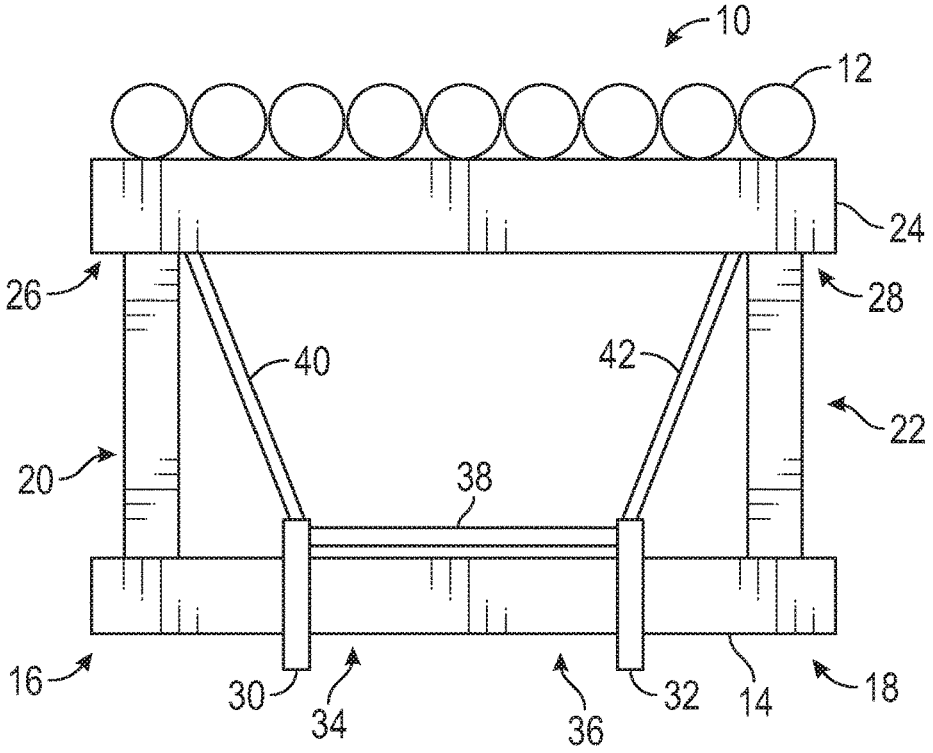
FIG. 1 is a diagram of a drum assembly according to embodiments of the present disclosure.

Embodiments of the present disclosure relate generally to systems used for deploying coils of flexible pipe. The coils of pipe may be self-supported, for example, using bands to hold coils together. Coil handling drum assemblies (coil drums) according to embodiments of the present disclosure may be of a fixed diameter or may be expandable in the radial direction.

Embodiments of the present disclosure will be described below with reference to the figures. In one aspect, embodiments disclosed herein relate to embodiments for handling coils using expandable drum assemblies.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

The disclosure provided with respect to FIGS. 1-5B illustrate a block diagram of one or more examples of one or more drum assemblies 10 that may be utilized with one or more embodiments of the coil deployment trailer system. FIG. 1 illustrates a block diagram of one example of a drum assembly 10. As described in detail below, spoolable pipe 12 may be disposed about the drum assembly 10 to enable handling of the spoolable pipe 12. Spoolable pipe 12 may refer to any type of flexible pipe or piping capable of being bent into a coil. Such coils of spoolable pipe 12 may reduce the amount of space taken up by pipe during manufacturing, shipping, transportation, and deployment compared to rigid pipe that is not capable of being bent into a coil.

Pipe, as understood by those of ordinary skill, may be a tube to convey or transfer any water, gas, oil, or any type of fluid known to those skilled in the art. The spoolable pipe 12 may be made of any type of materials including without limitation plastics, metals, a combination thereof, composites (e.g., fiber reinforced composites), or other materials known in the art. The flexible pipe of the spoolable pipe 12 is used frequently in many applications, including without limitation, both onshore and offshore oil and gas applications. Flexible pipe may include Flexible Composite Pipe (FCP) or Reinforced Thermoplastic Pipe (RTP). A FCP or RTP pipe may itself be generally composed of several layers. In one or more embodiments, a flexible pipe may include a thermoplastic liner or internal pressure sheath having a reinforcement layer and a thermoplastic outer cover layer. In one or more embodiments, the thermoplastic may be high density polyethylene (HDPE). Thus, flexible pipe may include different layers that may be made of a variety of materials and also may provide corrosion resistance. For example, in one or more embodiments, pipe used to make up a coil of pipe may have a corrosion protection outer cover layer that is disposed over another layer of steel reinforcement. In this embodiment, helically wound steel strips may be placed over a liner made of thermoplastic pipe. Flexible pipe may be designed to handle a variety of pressures. Further, flexible pipe may offer unique features and benefits versus steel/carbon steel pipelines in the area of corrosion resistance, flexibility, installation speed and re-usability.

The drum assembly 10 of FIG. 1 also includes a support bar 14 having a first end 16 and a second end 18. The support bar 14 is used to handle the drum assembly 10 and various components are coupled to the support bar 14, as described in further detail below. In certain embodiments, a first plurality of expandable spokes 20 are coupled to the support bar 14 proximate the first end 16 and a second plurality of expandable spokes 22 are coupled to the support bar 14 proximate the second end 18. In addition, each of a plurality of drum segments 24 are mounted to a distal end 26 of one of the first plurality of expandable spokes 20 and a distal end 28 of one of the second plurality of expandable spokes 22. The drum segments 24 extend parallel to the support bar 14. For clarity, only one expandable spoke 20, one expandable spoke 22, and one drum segment 24 are shown in FIG. 1. The plurality of drum segments 24 are used to support the spoolable pipe 12 and the distal ends 26 and 28 of the first and second pluralities of expandable spokes 20 and 22 are movable between retracted and extended positions, as described in more detail below. Thus, the drum assembly 10 is configured to be easily inserted and withdrawn from coils of spoolable pipe 12 and to be used with coils of spoolable pipe 12 of different inner diameters.

The drum assembly 10 also includes a first support bracket 30 disposed on the support bar 14 near the first end 16 and a second support bracket 32 disposed on the support bar 14 near the second end 18. The first support bracket 30 is moveable along a first longitudinal section 34 of the support bar 14 and the second support bracket 32 is moveable along a second longitudinal section 36 of the support bar 14. A primary mechanical actuator 38 may extend between the first support bracket 30 and the second support bracket 32. The primary mechanical actuator 38 may be used to move the first support bracket 30, the second support bracket 32, or both brackets 30 and 32. A first plurality of secondary mechanical actuators 40 may extend between the first support bracket 30 and one of the plurality of drum segments 24. A second plurality of secondary mechanical actuators 42 may also extend between the second support bracket 32 and one of the plurality of drum segments 24. For clarity, only one secondary mechanical actuator 40 and one secondary mechanical actuator 42 are shown in FIG. 1. In certain embodiments, the first plurality of secondary mechanical actuators 40 may extend between one of the first plurality of expandable spokes 20 and the first support bracket 30, and the second plurality of secondary mechanical actuators 42 may extend between one of the second plurality of expandable spokes 22 and the second support bracket 32. As described in detail below, the first and second pluralities of secondary mechanical actuators 40 and 42 may be used to move the first and second pluralities of expandable spokes 20 and 22 between retracted and extended positions, respectively.

Figure 2:
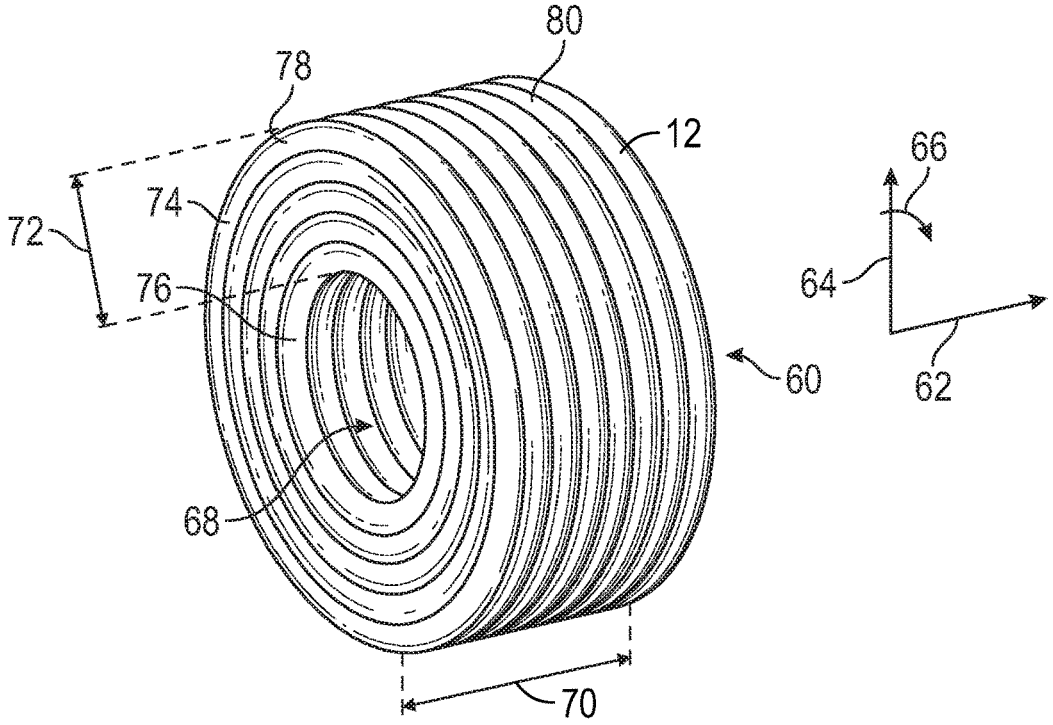
FIG. 2 is a perspective view of a coil of spoolable pipe according to embodiments of the present disclosure.

FIG. 2 illustrates a perspective view of an embodiment of a coil 60 of spoolable pipe 12. The coil 60 may be defined by an axial axis or direction 62, a radial axis or direction 64, and a circumferential axis or direction 66. The coil 60 may be formed by wrapping the spoolable pipe 12 into a coil with an interior channel 68 formed axially 62 therethrough, where the coil 60 may be moved as a single package or bundle of coiled pipe, as shown in FIG. 2. Each complete turn of coiled pipe may be referred to as a wrap of pipe. Multiple wraps of pipe in the coil 60 may be configured in columns along the axial direction 62 of the coil 60 and/or configured in layers along the radial direction 64 of the coil 60. For example, multiple columns of wraps may be formed along the axial direction 62 of the coil 60, where an axial dimension 70 of the coil 60 is based on the diameter of the pipe 12 and the number and axial 62 position of wraps forming the coil 60. Further, multiple layers of wraps may be formed along the radial direction 64 of the coil 60, where a radial dimension 72 of the coil 60 is based on the diameter of the pipe and the number and radial 64 position of the wraps forming the coil 60. In certain embodiments, a weight of the coil 60 may exceed 40,000 pounds (18,144 kilograms).

As shown in FIG. 2, the coil 60 of spoolable pipe 12 may be one or more layers (e.g., layers 74 and 76) of pipe packaged or bundled into the coil 60. The coil 60 may include at least one or more layers of pipe that have been coiled into a particular shape or arrangement. As shown in FIG. 2, the coil 60 is coiled into a substantially cylindrical shape having substantially circular bases 78 and 80 formed on each end of the coil 60, where the axial dimension 70 of the coil 60 is measured between the two bases 78 and 80.

As known to those of ordinary skill in the art, the spoolable pipe 12 used to make up the coil 60 shown in FIG. 2 may be coiled using spoolers or other coiler machines suited for such a function. Those of ordinary skill will recognize that the present disclosure is not limited to any particular form of coiler or other device that may be used to form pipe into a coil. Coiling pipe into a coil of pipe, such as 60, assists when transporting pipe, which may be several hundred feet in length in one or more embodiments. Further, the coil 60 may be assembled as a coil to facilitate deployment of the coil. Deployment, as used herein, may refer to the action of unspooling or unwinding the spoolable pipe 12 from the coil 60.

After being assembled into a coil, the coil 60 shown in FIG. 2 may include the interior channel 68 formed axially 62 through the coil 60. The interior channel 68 is a bore disposed generally in the center of the coil 60. The interior channel 68 is substantially circular-shaped. The coil 60 may have an outer diameter (OD) and an inner diameter (ID), where the inner diameter is defined by the interior channel 68.

Figure 3:
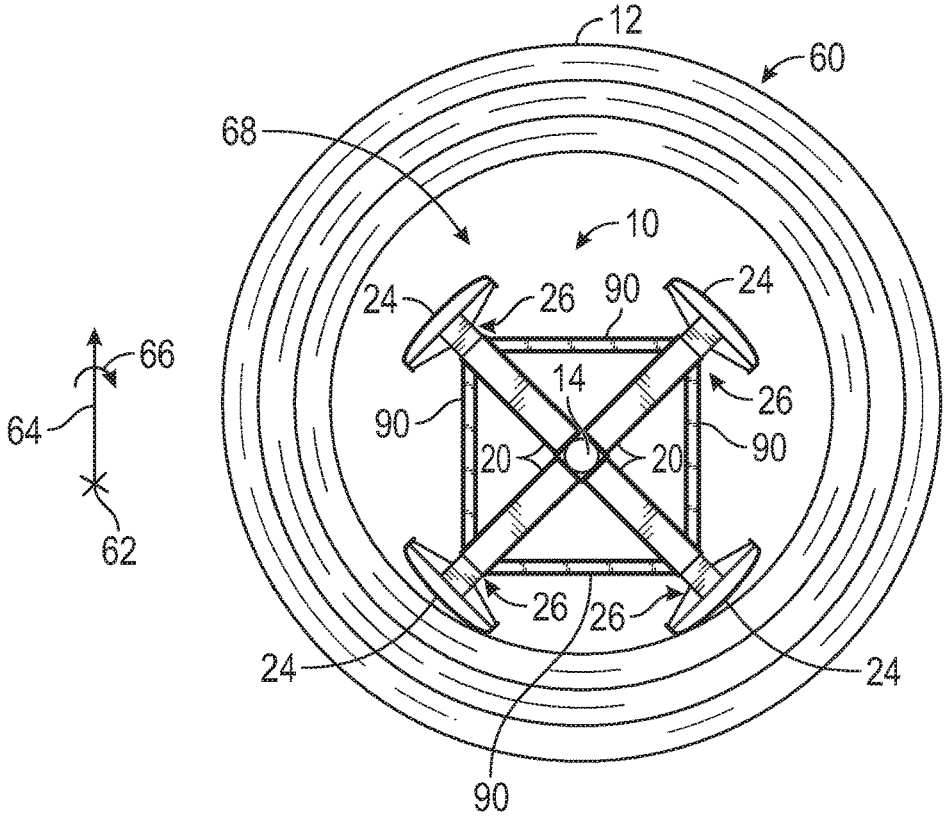
FIG. 3 is a side view of a drum assembly disposed in a retracted position according to embodiments of the present disclosure.

FIG. 3 illustrates a side view of the first end 16 of an embodiment of the drum assembly 10 disposed in the interior channel 68 of the coil 60 with each of the distal ends 26 of the first plurality of expandable spokes 20 in the retracted position. Thus, the drum assembly 10 may also be described as in the retracted position. As shown in FIG. 3, the retracted drum assembly 10 is disposed toward the bottom of the interior channel 68 resting on two of the plurality of drum segments 24. The other two of the plurality of drum segments 24 are not in contact with the coil 60. The retracted position of the drum assembly 10 may enable the drum assembly 10 to be easily inserted into the interior channel 68 with enough clearance to avoid contact with the coil 60 during insertion, thereby avoiding any possible damage to the spoolable pipe 12. The drum assembly 10 may be inserted into the interior channel 68 using a variety of different machinery and techniques as described in more detail below. In certain embodiments, a plurality of spoke frames 90 may be used to provide cross-support to the first plurality of expandable spokes 20. The plurality of spoke frames 90 may be rods, beams, columns, or similar objects coupled between each of the first plurality of expandable spokes 20 to provide support to the expandable spokes 20 during handling, shipment, expansion, and retraction of the drum assembly 10. Although the discussion above refers to the first end 16, it applies equally to the second end 18 and components of the drum assembly 10 disposed at the second end 18, such as the second plurality of expandable spokes 22. In addition, although four drum segments 24 are shown in FIG. 3, other embodiments of the drum assembly 10 may include different numbers of drum segments, such as, but not limited to, two, six, or eight drum segments 24.

Figure 4:
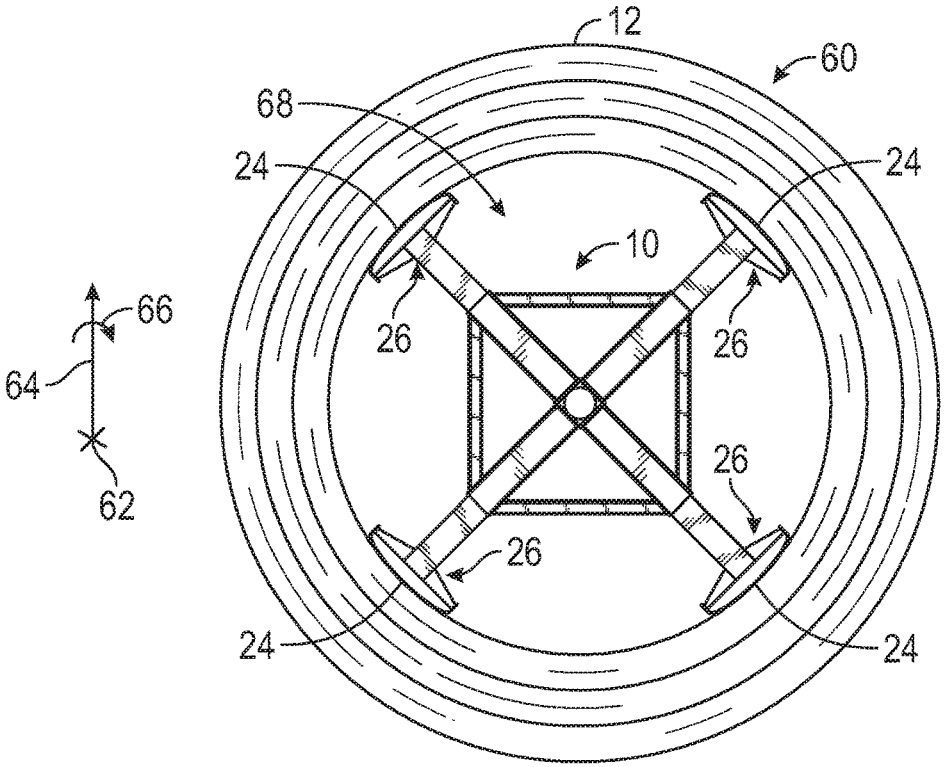
FIG. 4 is a side view of a drum assembly in an extended position according to embodiments of the present disclosure.

FIG. 4 illustrates a side view of the first end 16 of an embodiment of the drum assembly 10 disposed in the interior channel 68 of the coil 60 with each of the distal ends 26 of the first plurality of expandable spokes 20 in the extended position. Thus, the drum assembly 10 may also be described as in the extended position. As shown in FIG. 4, all of the plurality of drum segments 24 are in contact with the coil 60 with enough pressure on the interior channel 68 such that the coil 60 is secured to the drum assembly 10. Outer surfaces of the plurality of drum segments 24 may have a cross-sectional shape generally conforming with the curved shaped of the interior channel 68, thereby evenly distributing the pressure across the interior channel 68. In other words, the drum segments 24 may have a semi-circular shape to correspond to the semi-circular shape of the interior channel 68. Thus, the expanded drum assembly 10 may be used to fully support the coil 60, such as during handling and deployment of the coil 60. In particular, the expanded drum assembly 10 and coil 60 can be handled in a similar manner to spoolable pipe 12 disposed on a reel or spool. However, one drum assembly 10 may be used to handle many coils 60 without the logistics associated with empty reels or spools. In addition, use of the drum assembly 10 enables heavier coils 60 of spoolable pipe 12 to be handled and transported because the weight of reels or spools is not involved. As with FIG. 3, although the discussion above refers to the first end 16, it applies equally to the second end 18 and components of the drum assembly 10 disposed at the second end 18, such as the second plurality of expandable spokes 22.

Figure 5A:
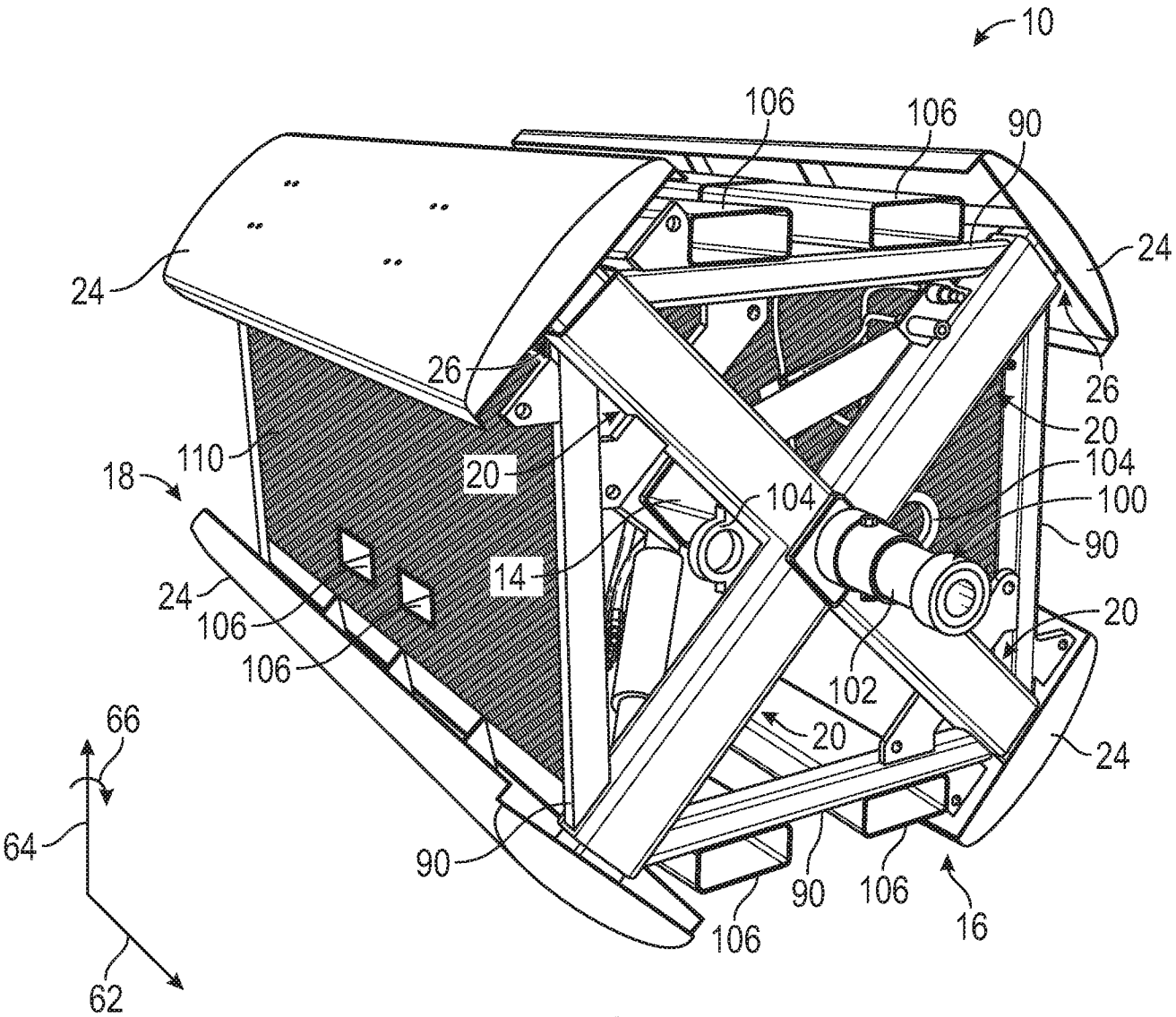
FIG. 5A is a perspective view of a drum assembly in a retracted position according to embodiments of the present disclosure.

FIG. 5A illustrates a perspective view of the first end 16 of an embodiment of the drum assembly 10 in the retracted position. As with previous figures, discussion referring to the first end 16 generally applies equally to the second end 18. As shown in FIG. 5A, the support bar 14 extends axially 62 through the center of the drum assembly 10. In certain embodiments, a first hub 100 is disposed at the first end 16 and the first hub 100 includes a first hub shaft 102, which may have a circular cross-sectional shape. Although not shown in the perspective view of FIG. 5A, the drum assembly 10 may also include a second hub and second hub shaft disposed at the second end 18 similar to the first hub 100 and first hub shaft 102. In certain embodiments, the first hub 100 and second hub may be referred to as integrated hubs because the first hub 100 and second hub may eliminate the use of a hollow support bar with open ends along the axial axis 62 of the drum assembly 10 for inserting a rod or pole for lifting and deploying the drum assembly 10. Instead, integrated hubs such as the first hub 100 and the second hub may act together with the support bar 14 as a fixed axle with respect to the drum assembly 10. In addition, the first hub shaft 102 and second hub shaft provide fixed locations for a user to grab or manipulate the drum assembly 10, either by hand or with a forklift, without using a rod, pole, or other similar lifting equipment.

In particular, the first hub 100 and second hub can be used to handle and move the drum assembly 10. In addition, when the drum assembly 10 is placed in an appropriate frame, trailer, or other deployment device, the first hub shaft 102 and second hub shaft may be used to enable rotation of the drum assembly 10. In other words, the first hub shaft 102 and second hub shaft may fit within a circular opening of the frame, trailer, or other deployment device, such as a coil deployment trailer system described herein with reference to FIGS. 6-10, to allow the drum assembly 10 to rotate. In certain embodiments, one or more pad-eyes 104 may be disposed at the first and second ends 16 and 18 to enable handling of the drum assembly 10. For example, straps, ropes, chains, or similar securement devices may be coupled to the pad-eyes 104 to facilitate movement of the drum assembly 10. The pad-eyes 104 may be coupled to the support bar 14, expandable spokes 20 or 22, spoke frames 90, or other appropriate locations of the drum assembly 10. In further embodiments, the drum assembly 10 may include at least two fork channels 106 that extend axially 62 or radially 64 along the support bar 14. The forks or tines of a forklift, truck, or similar machinery may be inserted into the fork channels 106 to enable lifting and moving the drum assembly 10. For example, fork channels 106 that extend axially 62 may be used to insert and remove the drum assembly 10 from the interior channel 68 of the coil 60. Fork channels 106 that extend radially 64 may be used to lift or set the drum assembly 10 from a truck, railcar, or similar transportation or used when access to the fork channels 106 extending axially 62 is limited or restricted. The fork channels 106 may be coupled to the support bar 14, expandable spokes 20 or 22, spoke frames 90, or other appropriate locations of the drum assembly 10.

In certain embodiments, the drum assembly 10 may include a cage 110 that at least partially covers one or more components of the drum assembly 10. For example, the cage 110 may help to protect components of the drum assembly 10 when the drum assembly 10 is moved or handled via the fork channels 106. The cage 110 may be made from expanded metal or mesh and coupled to the support bar 14, expandable spokes 20 or 22, spoke frames 90, fork channels 106, or other appropriate locations of the drum assembly 10.

One or more embodiments of a coil deployment trailer system for mounting and deploying spoolable pipe will now be described with reference to FIGS. 6-10. In one or more embodiments, the coil deployment trailer system is utilized to store, transport, manipulate, translate, collect and deploy various sizes of coil drums that are loaded with coils 60 of spoolable pipe 12. For example, one or more embodiments of the coil deployment trailer system are configured to manipulate packages of flexible pipe that include coils of different widths (i.e., axial dimensions 70) and/or heights (i.e., radial dimensions). In one or more of these embodiments, the coil deployment trailer system is configured to manipulate a coil drum that is configured as an expandable drum assembly, such as, for example, expandable drum assembly 301 that has a similar configuration to drum assembly 10. For example, as best shown in FIG. 8, expandable drum assembly 301 includes a first hub shaft 305 of a first hub 303 and a second hub shaft 309 of a second hub 307 that are configured and operate in a similar manner as the first hub 100, hub shaft 102, second hub and second hub shaft described in FIG. 5A with respect to the drum assembly 10. In this manner, coils 60 of spoolable pipe 12 of various widths and various outer diameters, including coils 60 that have outer diameters of up to 16 feet or more, that are disposed on an expandable drum assembly 301 or other expandable drum assemblies, can be deployed utilizing one or more embodiments of the coil deployment trailer system described herein.

Figure 5B:
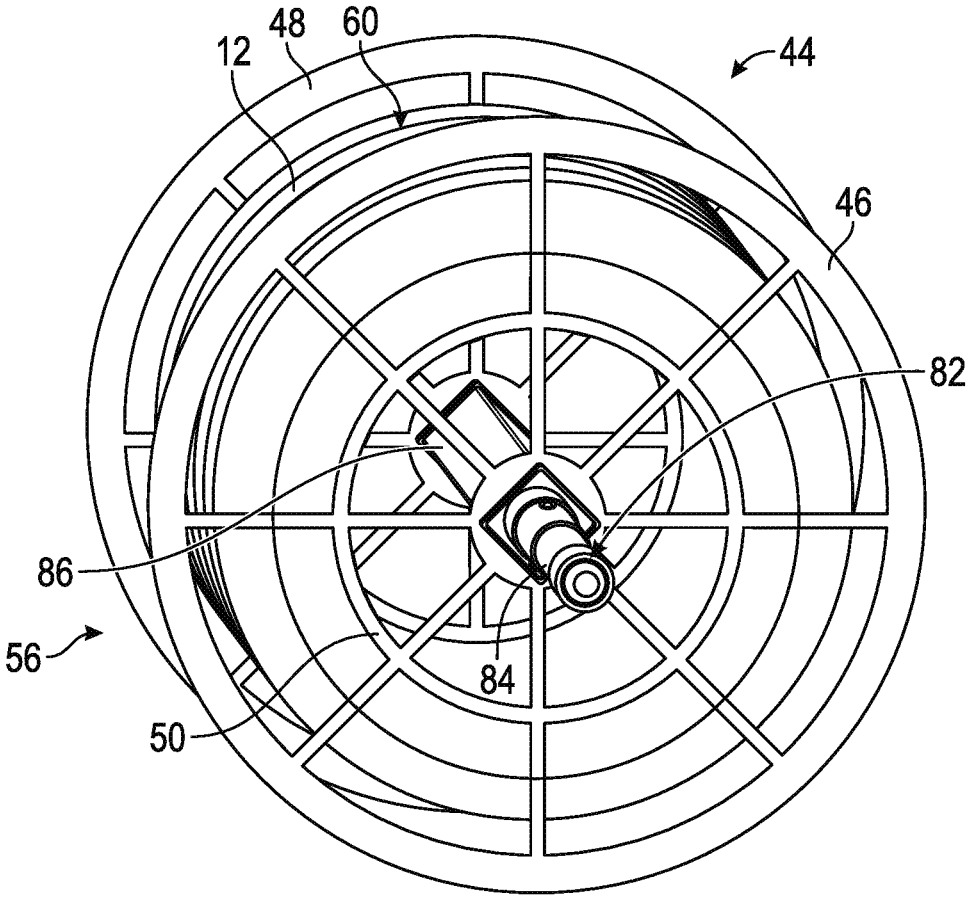
FIG. 5B is a perspective view of a reel of spoolable pipe according to embodiments of the present disclosure.

In one or more other embodiments, the coil deployment trailer system is utilized to store, transport, manipulate, translate, collect and deploy various sizes of coils 60 of spoolable pipe 12 that are disposed on a reel, such as reel 44 shown in FIG. 5B. In these embodiments, the coil 60 of spoolable pipe 12 may be wound around the reel 44 such that the interior channel of the coil 60 of pipe 12 is concentric with a central bore 52 of the reel. A reel as understood by those of ordinary skill may include a cylindrical drum, such as cylindrical drum 50, around which layers of pipe 12 may be wrapped to form a coil of pipe, such as coil 60 of pipe 12. Reel 44 may include two substantially circular reel ends 46 and 48 that are capable of turning about a shared axis. Accordingly, reel ends 46 and 48 may be attached to cylindrical drum 50. Reel 44 may also include a first hub 82 disposed at the first end 54 and the first hub 82 includes a first hub shaft 84, which may have a circular cross-sectional shape. Although not shown in the perspective view of FIG. 5B, reel 44 also includes a second hub and second hub shaft disposed at the second end 56 similar to the first hub 82 and first hub shaft 84. In certain embodiments, the first hub 82 and second hub may be referred to as integrated hubs because the first hub 82 and second hub may eliminate the use of a hollow support bar with open ends along the axial axis of the central bore 52 of the reel 44 for inserting a rod or pole for lifting and deploying the reel 44. Instead, integrated hubs such as the first hub 82 and the second hub may act together with the support bar 86 as a fixed axle with respect to the reel 44. In addition, the first hub shaft 84 and second hub shaft provide fixed locations for a user to grab or manipulate the reel 44, either by hand or with a forklift, without using a rod, pole, or other similar lifting equipment. In particular, one having skill in the art with the benefit of the teachings provided the present disclosure appreciates that the first hub 82 and second hub can be used to manipulate and move the reel 44 using the coil deployment system disclosed herein in a similar manner as the coil deployment system disclosed herein utilizes the expandable drum assembly 301 described in one or more embodiments herein. In other words, the reel 44 is configured such that it can be utilized in place of the expandable drum assembly 301 in one or more embodiments of the coil deployment trailer system, described herein with reference to FIGS. 6-10, to allow the reel 44 to rotate such that a user can manipulate the coil 60 of spoolable pipe 12 in a similar manner as the coil 60 of spoolable pipe 12 disposed on the expandable drum assembly 301. In this manner, reels 44 of various widths loaded with coils 60 of spoolable pipe 12 of various outer diameters, including coils 60 that have outer diameters of up to 16 feet or more, can be deployed utilizing one or more embodiments of the coil deployment trailer system.

Figure 6A:
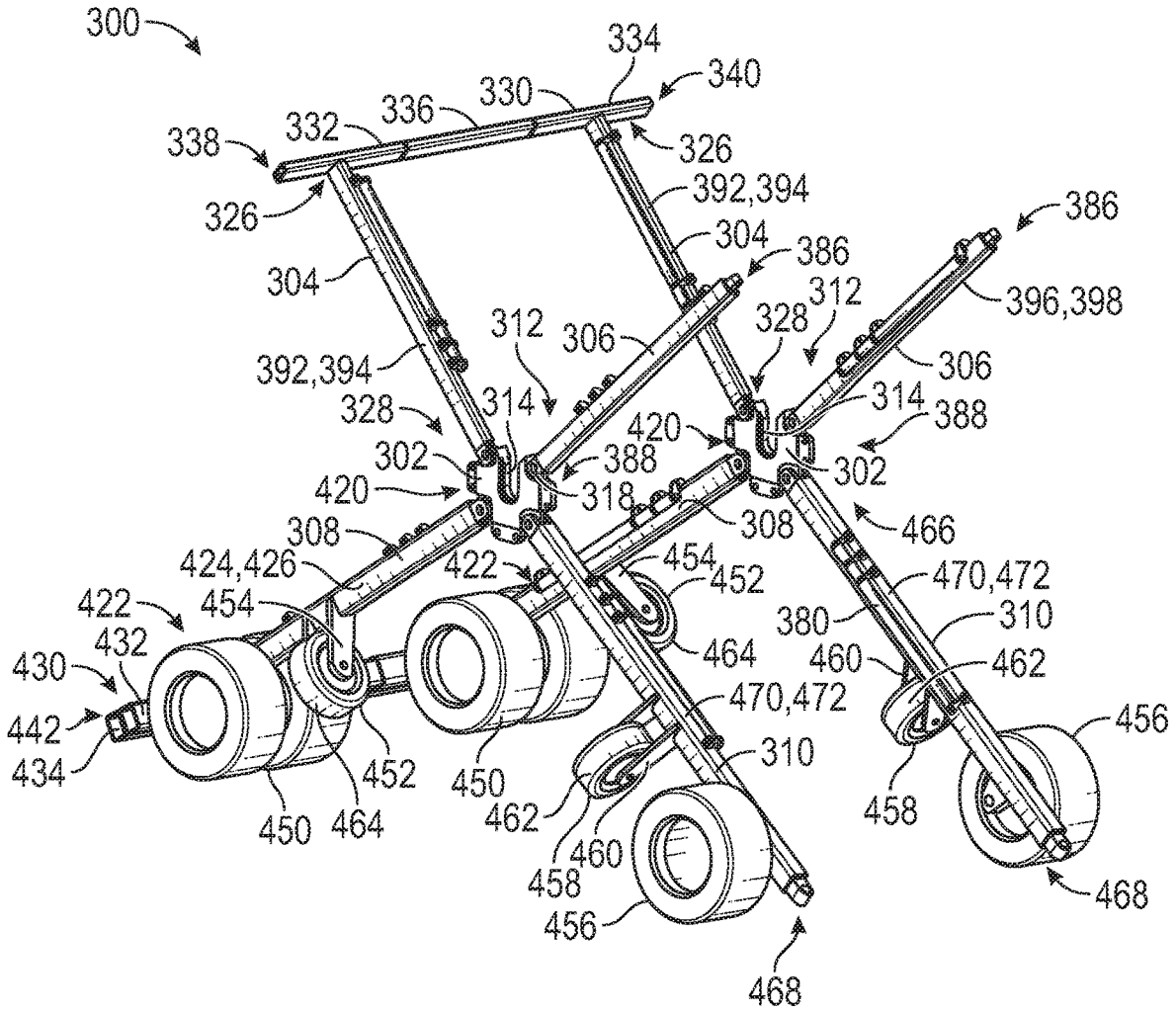
FIG. 6A is a perspective view of an unloaded trailer frame according to one or more embodiments of the present invention.
Figure 6B:
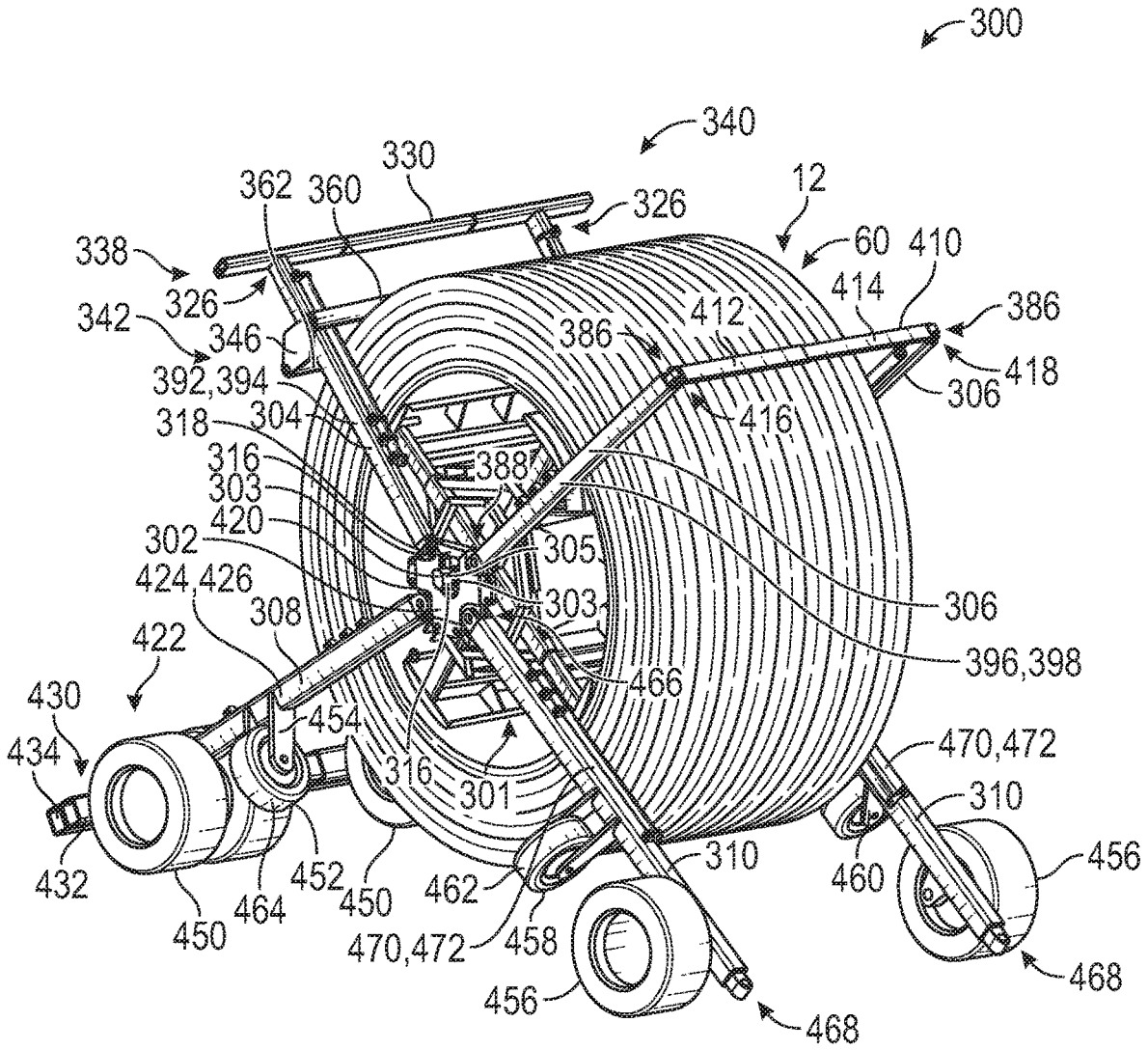
FIG. 6B is a perspective view of a trailer frame mounted with a drum assembly loaded with a coil of pipe mounted on the trailer frame according to one or more embodiments of the present invention.

One or more of these embodiments of a coil deployment trailer system will now be described herein with reference to FIGS. 6A and 6B. As illustrated in FIGS. 6A and 6B, the coil deployment trailer system includes a coil deployment trailer frame 300 that is configured to deploy, collect, store and transport a coil 60 of spoolable pipe 12. The coil deployment trailer frame 300 is collapsible (e.g., the width and height of the coil deployment trailer frame 300 can be adjusted to manipulate various sizes of coils 60 of spoolable pipe 12 that are disposed on a drum coil, such as for example, the expandable drum assembly 301 or any drum assembly that includes a hub shaft that is operable to provide support in the lifting and securing of the coil drum that is loaded with a spoolable pipe, and operable to assist in the rotation of the of the coil drum about the axis of the coil drum to deploy and collect spoolable pipe, such as spoolable pipe 12) via one or more actuators included in one or more components of the coil deployment trailer frame 300. Once a suitable height of the coil deployment trailer frame 300 is achieved, the trailer frame can be manipulated and positioned to mount the expandable drum assembly 301 on the coil deployment trailer frame 300. In one or more embodiments, both the width and the height of the coil deployment trailer frame 300 can be varied to lift the expandable drum assembly 301 off the ground to a position in which a coil 60 of spoolable pipe 12 can be stored, lifted, collected, dispensed and/or transported. In these embodiments, hydraulic cylinders can be utilized to vary the width of the coil deployment trailer frame 300 such that various sizes of coil assemblies can be manipulated to both store and deploy the spoolable pipe 12. For example, in or more embodiments, the coil deployment trailer frame 300 can be collapsed, to achieve a width as little as 8.5 feet, and can be expanded to achieve a width between 12 to 15 feet, depending upon the configuration of the coil deployment trailer frame 300, such that the coil deployment trailer system can store, lift, collect, dispense and transport spoolable pipe 12 that is disposed on coils 60 having various widths 70 (i.e., axial dimensions). The coil deployment trailer system can also manipulate various sizes of coils 60 that have different heights (e.g., coils 60 of spoolable pipe 12 that have different radial dimensions 72 based on the outer diameter of the pipe 12 and the number and radial 64 position of the wraps forming the coil 60) to contain and stabilize the expandable drum assembly 301 during de-banding and deployment of the spoolable pipe 12. In certain embodiments, the weight of the coil 60 can exceed 40,000 pounds (18,144 kilograms). One having skill in the art with the benefit of the teachings provided herein appreciates that one or more embodiments of the coil deployment trailer system of the present invention can also be configured to utilize various coil drum assemblies that include hub shafts that are configured to engage bracket supports 302 described herein such that the coil drum assembly can be manipulated to deploy, collect, transport, store, etc., spoolable pipe 12 disposed on the coil drum assembly, as described herein.

As illustrated in FIGS. 6A and 6B, one or more embodiments of the coil deployment trailer frame 300 generally include a pair of support brackets 302, a first pair of upper support arms 304, a second pair of upper support arms 306, a first pair of lower support arms 308 and a second pair of lower support arms 310 pivotably connected to the support brackets 302. In one or more embodiments, as shown in FIG. 6B, one of the pair of support brackets 302 includes a hub engagement section 312 that is configured to matingly and interlockingly engage a first hub shaft of a first hub, such as, for example, first hub shaft 305 of first hub 303, that has a similar configuration to first hub shaft 102 of the first hub 100 described with respect to FIG. 5A. Similarly, in one or more embodiments, the other support bracket of the pair of support brackets 302 includes a hub engagement section 312 that is configured to matingly and interlockingly engage a second hub shaft 309 of a second hub 307 (hidden from view in FIG. 6B, that has a similar configuration to second hub shaft of the second hub described with respect to FIG. 5A. In one or more embodiments, the hub engagement section 312 includes a substantially U-shaped inner engagement surface 314 and a hub securement latch 316. The hub engagement section 312 is configured such that that the first hub 303 and the second hub 307 can rotate along the axial axis of the expandable drum assembly 301 such that the expandable drum assembly 301 can rotate while spoolable pipe is being deployed from the expandable drum assembly 301. The hub securement latch 316 included in each support bracket 302 is configured to matingly and interlockingly engage the first hub shaft 305 and the second hub shaft, respectively, such that the expandable drum assembly 301 is secured to the coil deployment trailer frame 300 until the hub securement latch 316 is disengaged from the expandable drum assembly 301. In these embodiments, the expandable drum assembly 301 is free to rotate along the axial axis 62 of the expandable drum assembly 301 and secured along the radial axis 64 (i.e., the up/down direction generally perpendicular to the axial axis 62) of the expandable drum assembly 301, while the hub securement latch 316 is engaged, such that the spoolable pipe 12 can be deployed from the expandable drum assembly 301 while the expandable drum assembly 301 is secured to the coil deployment trailer frame 300. Each support bracket 302 further includes four pivotable connections 318 to which the first pair of upper support arms 304, second pair of upper support arms 306, first pair of lower support arms 308 and second pair of lower support arms 310 are securely and pivotably attached.

As illustrated in FIGS. 6A and 6B, each support arm included in the first pair of support arms 304 includes a first end 326 connected to a coupling assembly 330 and a second end 328 connected to the support bracket 302 via pivotable connection 318. The length of coupling assembly 330 can be varied such that the distance between the first pair of upper support arms 304 can be adjusted to accommodate and manipulate coils 60 of various widths 70 (e.g., an axial dimension 70 of the coil 60 is based on the diameter of the pipe 12 and the number and axial 62 positions of wraps forming the coil 60).

In one or more embodiments, each of the upper support arms 304 is pivotably adjustable with respect to the support bracket 302 to which each support arm 304 is connected. In one or more of these embodiments, the upper support arms 304 are of a fixed length such that the height of the coil deployment trailer frame 300 is varied by changing the angular positions of each of the upper support arms 304 with respect to the corresponding support bracket 302 by rotating each upper support arm 304 about the corresponding pivotable connection 318 included in the support bracket 302 to which the support arm 304 is connected. In this manner, the height of the coil deployment trailer frame 300 can be changed to accommodate and manipulate coils 60 of spoolable pipe 12 of different radial dimensions 72 (e.g., a radial dimension 72 of the coil 60 is based on the diameter of the pipe and the number and radial 64 position of the wraps forming the coil 60) within the coil deployment trailer frame 300.

In one or more other embodiments, each of the upper support arms 304 includes two telescoping bars, including a male telescoping bar 392 and a female telescoping bar 394, such that the length of the upper support arms can be extended or retracted to change the height of the coil deployment trailer frame 300. In this manner, the coil deployment trailer frame 300 can accommodate and manipulate coils 60 of spoolable pipe 12 of different radial dimensions 72 (e.g., a radial dimension 72 of the coil 60 is based on the diameter of the pipe and the number and radial 64 position of the wraps forming the coil 60) within the coil deployment trailer frame 300. FIGS. 6A and 6B illustrate the coil deployment trailer frame 300 wherein each of the upper support arms 304, upper support arms 306, lower support arms 308 and lower support arms 310 are in a retracted configuration such that the male telescoping bars of the respective support arms are in the fully inserted position within the respective female telescoping bars. In one or more embodiments, as illustrated in FIGS. 6A and 6B, the male telescoping bars 392 included in each of the first pair of upper support arms 304 are pivotably connected at one end to the support bracket 302 at their respective pivotable connections 318, and the female telescoping bars 394 included each of the first pair of upper support arms 304 are connected to the coupling assembly 330. In one or more embodiments, the female telescoping bars 394 included each of the first pair of upper support arms 304 are pivotably connected at one end to the support bracket 302 at respective their respective pivotable connections 318, and the male telescoping bars 392 included each of the first pair of upper support arms 304 are connected to the coupling assembly 330. One having skill in the art and the benefit of the teachings provided herein appreciates that the telescoping bars included each of the first pair of upper support arms 304 can be disposed at an appropriate location along the length of the upper support arms 304 such that neither the male telescoping bars 392 nor the female telescoping bars 394 extend to the first ends 326 or the second ends 328 of the upper support arms 304 such that the upper support arms 304 are extendable from a middle section thereof. One having skill in the art and the benefit of the teachings provided herein appreciates that the telescoping bars included each of the first pair of upper support arms 304 can include other combinations of male and female telescoping bars, including for example, two female telescoping bars on either ends of a male telescoping bar, or two male telescoping bars one either sides of a female telescoping bar.

Each female telescoping bar 394 receives in telescoping manner the corresponding male telescoping bar 392 such that the length of the upper support arms 304 can be lengthened, by extending the upper male telescoping bars 392 from the lower female telescoping bars 394, or can be shortened by retracting the upper male telescoping bars 392. For example, hydraulic actuators, electric actuators, electromagnetic actuators, pneumatic actuators or similar means such as pneumatic cylinders or hydraulic cylinders or the like can be utilized to shorten or lengthen upper support arms 304. One having skill in the art and the benefit of the teachings provided herein appreciates that the upper support arms 304 can have a cross sectional shape that is configured to affect the purpose of the coil deployment trailer frame 300 disclosed herein. For example, the upper support arms 304 can have a cross sectional shape which is substantially rectangular, square, cylindrical, or any other shape known in the art. The upper support arms 304 can be substantially solid or have a substantially hollow center. One having skill in the art and the benefit of the teachings provided herein appreciates that the first pair of upper support arms 304 can be configured to accommodate the actuators described herein that operate to shorten or lengthen upper support arms 304 as described herein.

In one or more embodiments, means to extend and retract the first pair of upper support arms 304, as described herein, such that, for example, the male telescoping bars 392 are extended or retracted relative to the female telescoping bars 394, are utilized. For example, a piston cylinder operated by an electrical actuator can be mounted within each of the upper support arms 304 such that a rod is operated by the piston cylinder to extend or retract the male telescoping bars 392 in unison. In other embodiments, the telescoping means can include a hand crank jack, a mechanical power screw, an electrical actuator, a manual-powered jack including a hand or foot operated lifting mechanism or some combination of the aforementioned. Those having skill in the art appreciate that the actuating piston can be located in various positions on or within each of the upper support arms 304. In one or more embodiments, the upper support arms 304 are hollow and have a cross-section configured to accommodate a hydraulic cylinder and piston such that the cylinder and piston are disposed within the hollow space of the upper support arms 304. In one or more embodiments, a hydraulically, pneumatically, magnetically or electrically actuated piston can be mounted to a side of the upper support arms 304 and located beneath or adjacent the retractable male telescoping bars 392 or adjacent any side of the upper support arms 304.

As illustrated in FIGS. 6A and 6B, the first ends 326 of the upper support arms 304 are connected to the coupling assembly 330. In one or more embodiments, the upper support arms 304 can be welded to the coupling assembly 330. In other embodiments, mounting brackets are disposed on the coupling assembly 330 to receive upper support arms 304 and securely hold the upper support arms 304 in place relative to the coupling assembly 330. In one or more embodiments, the coupling assembly 330 includes a first female containment bar 332 extending from a first outer end 338 of the coupling assembly 330, a second female containment bar 334 spaced axially a distance away from the first female containment bar 332 and extending from a second outer end 340 of the coupling assembly 330, and a male containment bar 336 disposed between and telescopingly attached to the first 332 and second 334 female containment bars. The first female containment bar 332 and the second female containment bar 334 are configured to receive the male containment bar 336 in a telescoping manner such that the width dimension of the coupling assembly 330 can be lengthened, by extending the first female containment bar 332 and the second female containment bar 334 in an axial direction 62 toward the first and second ends 338 and 340 of the coupling assembly 330, and shortened by retracting in an axial direction 62 the first female and second female containment bars 332 and 334. As one having skill in the art and the benefit of the teachings provided herein appreciates, the length of the coupling assembly 330 and, thus, the width of the coil deployment trailer frame 300, can be varied by extending and contracting the first female and second female containment bars 332 with respect to the male containment bar 336 and as described herein. In one or more other embodiments, the coupling assembly 330 includes a pair of telescoping bars that further include a male telescoping bar and a female telescoping bar that are slidably connected to one another. In these embodiments, the length of the coupling assembly 330 can be adjusted by slidably adjusting the telescoping bars to move the free ends of the telescoping bars in relation to one another to adjust the length of the coupling assembly 330. In one or more embodiments, the coupling assembly 330 does not include any actuators. In these embodiments, the first female containment bar 332 and the second female containment bar 334 are configured to move in an axial direction with respect to the male containment bar 336 in a telescoping manner when the length of a horizontal support assembly 430 is adjusted, as described herein. In other embodiments, male telescoping bar and a female telescoping bar are configured to move in an axial direction with respect to one another in a telescoping manner when the length of the horizontal support assembly 430 is adjusted. In one or more embodiments, securement pins or positioning screws or other means for lockingly setting the length of the coupling assembly 330 can be used once the desired length of the coupling assembly 330 is achieved. In one or more other embodiments, hydraulic actuators, electric actuators, electro-magnetic actuators or similar means such as pneumatic cylinders or the like may be utilized to shorten or lengthen the coupling assembly 330 in concert with the horizontal support assembly 430. One having skill in the art and the benefit of the teachings provided herein appreciates that the coupling assembly 330 can have a cross sectional shape which is substantially rectangular, square, cylindrical, or any other shape known in the art and can be configured to accommodate the actuators described herein to shorten or lengthen the coupling assembly 330.

A pipe re-spooler assembly 342 is included in both the coil deployment trailer frame 300, and the coil deployment trailer frame 500 discussed herein with respect to FIGS. 7-10, and operates in a similar manner to perform the same functions in the coil deployment trailer frames 300 and 500. Therefore, the pipe re-spooler assembly 342 included in trailer frames 300 and coil deployment trailer frame 500 will be discussed with reference to FIG. 6B which illustrates a perspective view of one or more embodiments of the re-spooler assembly 342, and FIG. 8 which illustrates a top view of one or more embodiments of the re-spooler assembly 342. In one or more embodiments, as illustrated in FIG. 6B and FIG. 8, the pipe re-spooler assembly 342 can be coupled to the coil deployment trailer frame 300 and can be used to facilitate the collection of spoolable pipe 12 around the expandable drum assembly 301, the deployment of spoolable pipe 12, the slowing of the rotation of the expandable drum assembly 301 or the stopping of the rotation of the expandable drum assembly 301 to stop deployment or collection of spoolable pipe 12. As illustrated in FIG. 6B, one or more embodiments of the pipe re-spooler assembly 342 includes a re-spooler bracket assembly. In or more embodiments, the re-spooler bracket assembly includes a first re-spooler bracket 346 that is securely disposed on the first upper support arm 304 included in the pair of upper support arms 304, and a second re-spooler bracket 348 is securely disposed on the second upper support arm 304 included in the pair of upper support arms 304 such that the first and second re-spooler brackets 346 and 348 are spaced from one another. In one or more other embodiments, the first and second re-spooler brackets 346 and 348 are slidably secured to the first and second upper support arms 304, respectively, such that the pipe re-spooler assembly 342 can slidably engage the coil 60 of spoolable pipe 12 as the dimensional height 72 of the coil 60 changes during the deployment or collection of the spoolable pipe 12. Similarly, as illustrated in FIG. 8, the first and second re-spooler brackets 346 and 348 are slidably secured to the first pair of trailer support arms 502 such that the pipe re-spooler assembly 342 can slidably engage the coil 60 of spoolable pipe 12 as the dimensional height 72 of the coil 60 changes during the deployment or collection of the spoolable pipe 12.

In one or more embodiments, the pipe re-spooler assembly 342 includes first and second substantially cylindrical elongated members 360 and 362 that are substantially parallel to one another and configured to engage the coil of spoolable pipe 12 when the expandable drum assembly 301 is securely mounted in the coil deployment trailer frames 300,500. The first substantially cylindrical elongated member 360 includes two interconnected telescoping bars, including a male telescoping bar 374 extending from a first end 364 of the first substantially cylindrical elongated member 360 and a female telescoping bar 376 extending from a second end 366 of the first substantially cylindrical elongated member 360. Similarly, the second substantially cylindrical elongated member 362 includes two interconnected telescoping bars, including a male telescoping bar 378 extending from a first end 370 of the second substantially cylindrical elongated member 362 and a female telescoping bar 380 extending from a second end 372 of the second substantially cylindrical elongated member 362.

In one or more embodiments, the first substantially cylindrical elongated member 360 is a roller and is connected to the re-spooler brackets 346 and 348 and configured to rotate about a first axle 352 disposed on the bracket 346 and a second axle 356 disposed on the second bracket 348. In these embodiments, the second substantially cylindrical elongated member 362 is a roller connected to the re-spooler brackets 346 and 348 and configured to rotate about a first axle 354 disposed on the bracket 346 and a second axle 358 disposed on the second bracket 348, respectively. In one or more embodiments, the female telescoping bars 376 and 380 are longer than their respective male bars 374 and 378 such that the female telescoping bars contact more of the surface of the coil of spoolable pipe 12 when the first and second elongated members 360 and 362 engage the spoolable pipe 12. In one or more other embodiments, the first and second substantially cylindrical elongated members 360 and 362 are stationary members with respect to their respective axes and are configured to assist in the stabilization of the spoolable pipe 12 as it is being taken up by or dispensed from the expandable drum assembly 301. In these embodiments, the first and second substantially cylindrical elongated members 360 and 362 may be coated with an anti-friction coating to help reduce the friction between the elongated members and the spoolable pipe 12.

In one or more embodiments, the re-spooler brackets 346 and 348 of the re-spooler assembly 342 can be fixedly coupled to the first pair of upper support arms 304 such that the positions of the first and second substantially cylindrical elongated members 360 and 362 are fixed in their respective positions. Similarly, with respect to coil deployment trailer frame 500, in one or more embodiments, the first and second re-spooler brackets 346 and 348 can be fixedly coupled to the trailer support arms 502 such that the positions of the first and second substantially cylindrical elongated members 360 and 362 are fixed in their respective positions. In other embodiments, the positions of the first and second substantially cylindrical elongated members 360 and 362, via the re-spooler brackets 346 and 348, are adjustable to accommodate coils 60 of spoolable pipe 12 of different heights 72. For example, the position of the re-spooler brackets 346 and 348 can be moved in a radial direction 64 (e.g., up and down) along the length of the first pair of upper support arms 304 such that coils 60 of various heights can be secured to the coil deployment trailer frame 300 for manipulation. Similarly, with respect to the coil deployment trailer frame 500, the position of the re-spooler brackets 346 and 348 can be moved in a radial direction 64 (e.g., up and down) along the length of the trailer support arms 502 such that coils 60 of various heights can be secured to the coil deployment trailer frame 500 for manipulation. In other embodiments, the re-spooler brackets 346 and 348 can be moved in an axial direction 62 (e.g., closer or further apart from one another) to accommodate coils 60 of various widths 70. In these embodiments, the female telescoping bars 376 and 380 receive their respective male bars 374 and 378 in telescoping manner such that the length of the substantially cylindrical elongated members 360 and 362 can be lengthened by extending the elongated members 360 and 362, or can be shortened by retracting the elongated members 360 and 362.

In one or more embodiments, the pipe re-spooler assembly 342 does not include actuators such that the first substantially cylindrical elongated member 360 and the second substantially cylindrical elongated member 362 are configured to freely extend or contract in an axial direction and in a telescoping manner when the length of the horizontal support assembly 430 is adjusted, as described herein. In one or more embodiments, securement pins or positioning screws or other means for lockingly setting the length of the pipe re-spooler assembly 342 can be used once the desired length of the pipe re-spooler assembly 342 is achieved. In one or more embodiments, hydraulic actuators, electric actuators, or similar means such as pneumatic cylinders or the like may be utilized to shorten or lengthen the pipe re-spooler assembly 342. Adjustment of the substantially cylindrical elongated members 360 and 362 can be accomplished hydraulically, electrically, magnetically, pneumatically, or a combination of the aforementioned in a similar manner as discussed herein with respect to the first pair of upper support arms 304. For example, the substantially cylindrical elongated members 360 and 362 can be configured to accommodate similar actuators, as described herein with respect to the first pair of upper support arms 304, that operate to shorten or lengthen the substantially cylindrical elongated members 360 and 362.

In the illustrated embodiments shown in FIGS. 6B and 18, the pipe re-spooler assembly 342 includes two substantially cylindrical elongated members 360 and 362 at the rear side of the coil 60. In other embodiments, different numbers (e.g., one (1), three (3), or four (4)) of cylindrical elongated members 360 and/or 362 can be utilized within one or more pipe re-spooler assemblies 342 to engage the coil 60 spoolable pipe 12. In these embodiments, the pipe re-spooler assemblies 342 can be disposed at other locations, such as the front side of the coil 60 of spoolable pipe 12, or along both of the front and rear sides of the coil 60 of spoolable pipe 12. In one or more embodiments, the pipe re-spooler assembly 342 can include a braking mechanism that utilizes a brake actuator to apply braking forces to the substantially cylindrical elongated members 360 and 362 to slow the rotation of the substantially cylindrical elongated members 360 and 362 to slow or stop the rotation of the expandable drum assembly 301 while the expandable drum assembly 301 is being utilized to deploy spoolable pipe 12 or collect spoolable pipe 12. In one or more embodiments, the brake actuator can be an electric actuator, a hydraulic actuator, a pneumatic actuator or a type of motor to move the braking mechanism to slow or stop the rotation of the substantially cylindrical elongated members 360 and 362. For example, a brake pad can be moved towards or away from the rotation of the substantially cylindrical elongated members 360 and 362 to apply or disengage a braking force, respectively, to or from the substantially cylindrical elongated members 360 and 362.

One having skill in the art and the benefit of the teachings provided herein appreciates that various pivotable connections 318 included in the pair of brackets 302 can be utilized to pivotably connect the support brackets 302 to the first and second pair of upper support arms 302 and 304, respectively, and the first and second pair of lower support arms 308 and 310, respectively, to allow the first and second pair of upper support arms 302 and 304 and the first and second pair of lower support arms 308 and 310 to pivot in a circumferential direction 66 at the pivotable joint connections 318 with respect to the support bracket 302. For example, the joint connections can include one or a combination of one or more of ball joint connections, pins, ball bearing assemblies, screws, bolts, bolt and nut assemblies, etc.

As illustrated in FIGS. 6A and 6B, one or more embodiments of the coil deployment trailer system includes the second pair of upper support arms 306 having a first end 386 connected to a horizontal containment bar 410 and a second end 388 pivotably connected to the support bracket 302. In one or more embodiments, the horizontal containment bar 410 can be removed, as illustrated in FIG. 6A, or pivotably disconnected on one side thereof such that a coil 60 of spoolable pipe 12 can be positioned within the coil deployment trailer frame 300. In one or more embodiments, each of the upper support arms included in the second pair of upper support arms 306 is pivotably adjustable with respect to the support bracket 302 to which each support arm 306 is connected. In one or more of these embodiments, the second pair of upper support arms 306 is of a fixed length such that the height of the coil deployment trailer frame 300 can be changed by changing the angular positions of each of the upper support arms 306 with respect to the corresponding support bracket 302 by rotating each upper support arm 306 about the corresponding pivotable connection 318 included in the support bracket 302 to which the support arm 306 is connected. In this manner, the height of the coil deployment trailer frame 300 can be changed to accommodate and manipulate coils 60 of spoolable pipe 12 of different radial dimensions 72 (e.g., a radial dimension 72 of the coil 60 is based on the diameter of the pipe and the number and radial 64 position of the wraps forming the coil 60) within the coil deployment trailer frame 300.

In one or more other embodiments, each of the upper support arms included in the second pair of upper support arms 306 includes two telescoping bars including a male telescoping bar 396, illustrated in FIG. 6A in the retracted position, and a female telescoping bar 398. One having skill in the art and the benefit of the teachings provided herein appreciates that the length of the second pair of upper support arms 306, that includes the male telescoping bar 396 and the female telescoping bar 398, is adjustable in a similar manner as the length of the first pair of upper support arms 304, that include similar telescoping bar configurations, to similarly change the height of the coil deployment trailer frame 300. Thus, the operation of the telescoping bars included in the second pair of upper support arms 306 is similar to that described with respect to the first pair of upper arms 304. As with the first pair of upper arms 304, hydraulic actuators, electric actuators, or similar means such as pneumatic cylinders or the like may be utilized to shorten or lengthen upper support arms 306. One having skill in the art and the benefit of the teachings provided herein appreciates that the second pair of upper support arms 306 can have a cross sectional shape that is configured to affect the purpose of the coil deployment trailer system disclosed herein. For example, the upper support arms 306 can have a cross sectional shape which is substantially rectangular, square, cylindrical, or any other shape known in the art. The second pair of upper support arms 306 can be substantially solid or have a substantially hollow center. One having skill in the art and the benefit of the teachings provided herein appreciates that the second pair of upper support arms 306 can be configured to accommodate similar actuators described herein that operate to shorten or lengthen the first pair of upper support arms 304.

As illustrated in FIG. 6B, the first ends 386 of the second pair of upper support arms 306 are connected to the horizontal containment bar 410. In one or more embodiments, the second pair of upper support arms 306 can be welded to the horizontal containment bar 410. In other embodiments, mounting brackets are disposed on the horizontal containment bar 410 to receive upper support arms 306 and securely hold the upper support arms 306 in place relative to the horizontal containment bar 410. In one or more embodiments, the horizontal containment bar 410 includes a female containment bar 412 extending from a first outer end 416 of the containment bar 410, and a male containment bar 414 extending from a second outer end 418 of the horizontal containment bar 410. The female containment bar 412 is configured to receive the male containment bar 414 in a telescoping manner such that the horizontal containment bar 410 can be lengthened, by extending the male containment bar 414 in an axial direction 62 toward the second end 418 of the horizontal containment bar 410, and shortened by retracting in an axial direction 62 the first male containment bar 414. In one or more embodiments, the width of the coil deployment trailer frame 300 can be varied by extending and contracting the male containment bar 414 as described herein. In one or more other embodiments, the horizontal containment bar 410 does not include actuators such that the female containment bar 412 is configured to move with respect to the male containment bar 414 in an axial direction in a telescoping manner when the length of the horizontal support assembly 430 is adjusted, as described herein. In one or more embodiments, securement pins or positioning screws or other means for lockingly setting the length of horizontal containment bar 410 can be used once the desired length of horizontal containment bar 410 is achieved. In one or more embodiments, hydraulic actuators, electric actuators, or similar means such as pneumatic cylinders or the like may be utilized to shorten or lengthen the horizontal containment bar 410. One having skill in the art and the benefit of the teachings provided herein appreciates that the horizontal containment bar 410 can have a cross sectional shape which is substantially rectangular, square, cylindrical, or any other shape known in the art and can be configured to accommodate similar actuators described herein that operate to shorten or lengthen upper support arms 304.

As illustrated in FIGS. 6A and 6B, one or more embodiments of the coil deployment trailer system includes the first pair of lower support arms 308 having a first end 420 connected to the support brackets 302 and a second end 422 connected to the horizontal support assembly 430. As illustrated in FIGS. 6A and 6B, each of the lower support arms included in the first pair of lower support arms 308 is pivotably connected at one end 420 to the support bracket 302, at corresponding pivotable connections 318, and connected at a second end 422 to the horizontal support assembly 430. In one or more embodiments, each of the lower support arms included in the first pair of lower support arms 308 is pivotably adjustable with respect to the support bracket 302 at respective pivotable connections 318. In these embodiments, the height of the coil deployment trailer frame 300 is varied by changing the angular positions of each of the lower support arms 308 with respect to the corresponding support bracket 302 by rotating each lower support arm 308 about a corresponding pivotable connection 318 included in the support bracket 302 to which the lower support arm 308 is connected.

In one or more other embodiments, each lower support arm included in the first pair of lower support arms 308 includes two telescoping bars including a male telescoping bar 424, illustrated in FIG. 6A in the retracted position, and a female telescoping bar 426 such that the length of each of the lower support arms 308 can be extended or retracted to accommodate and manipulate coils 60 of spoolable pipe 12 of different radial dimensions 72 within the coil deployment trailer frame 300. FIGS. 6A and 6B illustrate one or more embodiments of the coil deployment trailer frame 300 wherein the first pair of lower support arms 308 and the second pair of lower support arms 310 are in a retracted configuration such that the male telescoping bars of the of the respective support arms included in the first and second pair of lower support arms 308,310 are in a fully inserted position within the respective female telescoping bars. In one or more embodiments, as illustrated in FIGS. 6A and 6B, the male telescoping bars 424 included in the first pair of lower support arms 308 are pivotably connected at one end to the support bracket 302 at corresponding pivotable connections 318, and the female telescoping bars 426 included in the first pair of lower support arms 308 are connected to the horizontal support assembly 430. One having skill in the art and the benefit of the teachings provided herein appreciates that the telescoping bars included each lower support arm included in the first pair of lower support arms 308 can be disposed at an appropriate location along the length of the lower support arms 308 such that neither the male telescoping bars 424 nor the female telescoping bars 426 extend to the first ends 420 or the second ends 422 of the lower support arms 308 such that the telescoping of the lower support arms 308 occurs solely within a middle section of the lower support arms 308. One having skill in the art and the benefit of the teachings provided herein appreciates that the telescoping bars included each of the first pair of lower support arms 308 can include other combinations of male and female telescoping bars, including for example, two female telescoping bars on either ends of a male telescoping bar, or two male telescoping bars one either sides of a female telescoping bar.

Each female telescoping bar 426 receives in telescoping manner the corresponding male telescoping bar 424 such that the first pair of lower support arms 308 can be lengthened by extending the male telescoping bars 424 from the female telescoping bars 426, or can be shortened by retracting the male telescoping bars 424 into the female telescoping bars 426. For example, hydraulic actuators, electric actuators, electro-magnetic actuators, pneumatic actuators or similar means such as pneumatic cylinders or hydraulic cylinders or the like can be utilized to shorten or lengthen the first pair of lower support arms 308. One having skill in the art and the benefit of the teachings provided herein appreciates that the first pair of lower support arms 308 can have a cross sectional shape that is configured to affect the purpose of the coil deployment trailer frame 300 disclosed herein. For example, the first pair of lower support arms 308 can have a cross sectional shape which is substantially rectangular, square, cylindrical, or any other shape known in the art. The first pair of lower support arms 308 can be substantially solid or have a substantially hollow center. One having skill in the art and the benefit of the teachings provided herein appreciates that the first pair of lower support arms 308 can be configured to accommodate the actuators described herein that operate to shorten or lengthen the first pair of lower support arms 308, as described herein.

In one or more embodiments, means to extend and retract the first pair of lower support arms 308, as described herein, such that, for example, the male telescoping bars 424 are extended or retracted relative to the female telescoping bars 426, are utilized. For example, a piston cylinder operated by an electrical actuator can be mounted within each lower support arm included in the first pair of lower support arms 308 such that a rod is operated by the piston cylinder to extend or retract the male telescoping bars 424 in unison. In other embodiments, the telescoping means can include a hand crank jack, a mechanical power screw, an electrical actuator, a manual-powered jack including a hand or foot operated lifting mechanism or a combination of one or more of the aforementioned. Those having skill in the art with the benefit of the teachings provided the present disclosure appreciate that the actuating piston can be located in various positions on or within each of the lower support arms 308. In one or more embodiments, the lower support arms 308 are hollow and have a cross-section configured to accommodate a hydraulic cylinder and piston such that the cylinder and piston are disposed within the hollow space of the lower support arms 308. In one or more embodiments, a hydraulically or electrically actuated piston can be mounted to a side of the lower support arms 308 and located beneath or adjacent the retractable male telescoping bars 424 or adjacent any side of the lower support arms 308.

In one or more embodiments, as illustrated in FIG. 6B, the second ends 422 of the first pair of lower support arms 308 are connected to the horizontal support assembly 430. In one or more embodiments, the first pair of lower support arms 308 can be welded to the horizontal support assembly 430. In other embodiments, mounting brackets are disposed on the horizontal support assembly 430 to receive lower support arms 308 and securely hold the lower support arms 308 in place relative to the horizontal support assembly 430.

The horizontal support assembly 430, which is included in one or more embodiments of the coil deployment trailer frame 300 described with respect to FIGS. 6A and 6B, and one or more embodiments of the coil deployment trailer frame 500 described with respect to FIGS. 7-10, will now be described in detail with reference to FIGS. 6A-6B and FIG. 8. The horizontal support assembly 430 will be discussed with reference to FIGS. 6A and 6B which illustrate a perspective view of one or more embodiments of the horizontal support assembly 430, and FIG. 8 which illustrates a top down view of one or more embodiments of the horizontal support assembly. In one or more embodiments described with respect to FIGS. 6A and 6B, the horizontal support assembly 430 is disposed between the lower support arms 308 included in the first pair of lower support arms 308. One having skill in the art with the benefit of the teachings provided herein appreciates that other embodiments of the coil deployment trailer frame 300 can dispose the horizontal support assembly 430 between the upper support arms included in the first pair of upper support arms 304 to enable the coil deployment trailer frame 300 to be adjusted to achieve various widths to accommodate coils 60 of various widths, as described herein. Similarly, in one or more embodiments described with respect to FIGS. 7-10, the horizontal support assembly 430 is disposed between the first ends 506 of the trailer support arms included in the first pair of trailer support arms 502. One having skill in the art with the benefit of the teachings provided herein appreciates that other embodiments of the coil deployment trailer frame 500 can dispose the horizontal support assembly 430 between the second ends 538 of the trailer support arms included in the second pair of trailer support arms 504 to enable the coil deployment trailer frame 500 to be adjusted to achieve various widths to accommodate coils 60 of various widths, as described herein.

In one or more embodiments, as illustrated in FIGS. 6A-6B and FIG. 8, the horizontal support assembly 430 includes two horizontal telescoping support bars, including a first horizontal telescoping support bar 432 and a second horizontal telescoping support bar 434. In these embodiments, the first horizontal telescoping support bar 432 and the second horizontal telescoping support bar 434 are configured to extend and contract in concert with one another to achieve a length that is substantially the same to adjust the width of the coil deployment trailer frame 300, 500.

For example, with reference to FIG. 8, the coil deployment trailer frame 500 includes a pair of trailer support arms 502, as will be discussed in more detail with reference to FIGS. 7-10 herein. In one or more embodiments of the coil deployment trailer frame 500, the first horizontal telescoping support bar 432 is generally perpendicular to the pair of trailer support arms 502, and includes a female telescoping extension arm 436, extending from a first end 440 of the horizontal support assembly 430, and a male telescoping extension arm 438 extending from a second end 442 of the horizontal support assembly 430. Similarly, the second horizontal telescoping support bar 434 is generally perpendicular to the pair of trailer support arms 502, and includes a female telescoping extension arm 444, extending from a first end 440 of the horizontal support assembly 430, and a male telescoping extension arm 446 extending from a second end 442 of the horizontal support assembly 430. The female telescoping extension arms 436 and 444 are configured to receive the male telescoping extension arms 438 and 446 in a telescoping manner such that the horizontal support assembly 430 can be lengthened, by extending the male telescoping extension arms 438 and 446 in an axial direction 62 toward the first end 440 of the horizontal support assembly 430, and shortened by retracting in an axial direction 62 the male telescoping extension arms 438 and 446.

Similarly, in one or more embodiments of the coil deployment trailer frame 300, discussed with reference to FIGS. 6A and 6B, the first horizontal telescoping support bar 432 is generally perpendicular to the first pair and second pair of lower support arms 308 and 310. As illustrated in FIG. 8, the first horizontal telescoping support bar 432 includes a female telescoping extension arm 436, extending from a first end 440 of the horizontal support assembly 430, and a male telescoping extension arm 438 extending from a second end 442 of the horizontal support assembly 430. In similar fashion to the coil deployment trailer frame 500, the second horizontal telescoping support bar 434 is generally perpendicular to the first pair and second pair of lower support arms 308 and 310 included in the coil deployment trailer frame 300 and includes a female telescoping extension arm 444 extending from a first end 440 of the horizontal support assembly 430, and a male telescoping extension arm 446 extending from a second end 442 of the horizontal support assembly 430. The female telescoping extension arms 436 and 444 are configured to receive the male telescoping extension arms 438 and 446 in a telescoping manner such that the horizontal support assembly 430 can be lengthened, by extending the male telescoping extension arms 438 and 446 in an axial direction 62 toward the first end 440 of the horizontal support assembly 430, and shortened by retracting in an axial direction 62 the male telescoping extension arms 438 and 446. In this manner, the width of the coil deployment trailer 300 can be varied, as discussed herein.

As one having skill in the art and the benefit of the teachings provided herein appreciates, the width of the coil deployment trailer frame 300, 500 can be varied, as described herein, by extending and retracting the male telescoping extension arms 438 and 446 to shorten or lengthen the horizontal support assembly 430. In one or more other embodiments, the width of the coil deployment trailer frame 300, 500 can be varied, as described herein, by extending and retracting the female male telescoping extension arms 436 and 444 to shorten or lengthen the horizontal support assembly 430. In one or more embodiments, hydraulic actuators, electric actuators, or similar means such as pneumatic cylinders or the like may be utilized to shorten or lengthen the horizontal support assembly 430. One having skill in the art and the benefit of the teachings provided herein appreciates that each of the horizontal telescoping support bars 432 and 434 included in the horizontal support assembly can have a cross sectional shape which is substantially rectangular, square, cylindrical, or any other shape known in the art and can be configured to accommodate similar actuators described herein that operate to shorten or lengthen upper support arms 304. As one having skill in the art and the benefit of the teachings provided herein appreciates, although the horizontal support assembly illustrated in FIGS. 6A-6B and FIG. 8 includes a dual actuated retractable telescoping support bars 432 and 434, a single actuated retractable telescoping support bar can be utilized.

In one or more embodiments, as illustrated in FIGS. 6A and 6B, each of the lower support arms included in the first pair of lower support arms 308 includes a set of wheels 450 that is utilized to assist in supporting, maneuvering and guiding the coil deployment trailer frame 300 both in the loaded condition (e.g., when the coil 60 of spoolable pipe 12 is mounted within the coil deployment trailer frame 300) and the unloaded condition (e.g., when the coil 60 of spoolable pipe is not mounted on the coil deployment trailer frame 300). In one or more embodiments, the set of wheels 450 is mounted on and disposed at or near the second end 422 of each lower support arm 308 included in the first pair of lower support arms 308. In other embodiments, the set of wheels 450 are disposed along the length of the first pair of lower support arms 308. The set of wheels 450 can be disposed at any location along the length of each lower support arm 308 such that each set of wheels 450 engages the floor to provide the requisite support, maneuverability, movement and positioning for both a loaded and unloaded coil deployment trailer frame 300. Although each set of wheels 450 as illustrated in FIGS. 6A and 6B includes 2 wheels, one having ordinary skill in the art will appreciate that each of set of wheels 450 can include one (1) wheel, three (3) wheels, four (4) wheels, etc. In one or more embodiments, each set of wheels can include a braking mechanism that utilizes a brake actuator to apply braking forces to the set of wheels 450 to slow the translation of the coil deployment trailer frame 300 in a particular direction across a surface or to completely stop the coil deployment trailer frame 300. In one or more embodiments, the brake actuator can be an electric actuator, a hydraulic actuator, a pneumatic actuator or a type of motor to move the braking mechanism to slow or stop the coil deployment trailer frame 300. For example, a brake pad can be moved towards or away from the set of wheels 450 to apply or disengage a braking force, respectively, to or from the set of wheels 450.

In one or more embodiments, as illustrated in FIGS. 6A and 6B, each of the lower support arms 308 included in the first pair of lower support arms 308 includes a set wheels 452 mounted on and disposed along the length of the lower support arm 308. The set of wheels 452 can include one (1) wheel, as illustrated in FIGS. 6A and 6B, or include two (2) wheels, three (3) wheels, etc. In one or more embodiments, the set of wheels 452 is connected to each lower support arm 308 by a bracket 454 that is configured such that the wheels are positioned at a ninety-degree (90°) angle with respect to the lower support arm 308, as illustrated in FIGS. 6A and 6B. Each of the wheels included in the set of wheels 450 is configured to have a diameter such that the engagement surface 464 of each wheel 452 does not contact the ground surface—e.g., to bring the engagement surface 464 of the wheels 452 to a substantially parallel alignment with a ground surface and enable the coil deployment trailer frame 300 to translate across the surface utilizing the set of wheels 452—until the height of the coil deployment trailer frame 300 is reduced to a collapsed position. In one or more embodiments, the set of wheels 452 can be configured as casters such that each set of wheels 452 has the ability to rotate three hundred and sixty degrees (360°) to move in any direction on the ground surface. In one or more other embodiments, the set of wheels 452 can be replaced with supporting feet that operate to sustain the weight of a loaded or unloaded coil deployment trailer frame 300 when the coil deployment trailer frame 300 is in a collapsed position.

As illustrated in FIGS. 6A and 6B, one or more embodiments of the coil deployment trailer frame 300 includes the second pair of lower support arms 310. Each lower support arm included in the pair of lower support arms 310 includes a first end 466 connected to the respective support bracket 302 and a second free end 468. As illustrated in FIGS. 6A and 6B, each of the lower support arms included in the second pair of lower support arms 310 is pivotably connected at one end 466 to the support bracket 302, at corresponding pivotable connection 318. In one or more embodiments, each of the lower support arms included in the second pair of lower support arms 310 is pivotably adjustable with respect to the support bracket 302 to which each lower support arm 310 is connected. In these embodiments, the height of the coil deployment trailer frame 300 is varied by changing the angular positions of the lower support arms 310 with respect to the corresponding support bracket 302 by rotating each lower support arm 310 about the corresponding pivotable connection 318 included in the support bracket 302 to which the lower support arm 310 is connected.

In one or more other embodiments, each lower support arm included in the second pair of lower support arms 310 includes two telescoping bars, including a male telescoping bar 470, illustrated in FIGS. 6A and 6B in the retracted position, and a female telescoping bar 472. One having skill in the art and the benefit of the teachings provided herein appreciates that each lower support arm included in the second pair of lower support arms 310 includes a male telescoping bar 470 and a female telescoping bar 472 such that the length of each lower support arm 310 is adjustable in a similar manner as described with respect to the first pair of lower support arms 308 that include similar telescoping bar configurations. Thus, the operation of the telescoping bars included in the second pair of lower support arms 310 is similar to that described with the respect to the first pair of lower support arms 308. As with the first pair of lower support arms 308, hydraulic actuators, electric actuators, or similar means such as pneumatic cylinders or the like may be utilized to shorten or lengthen the second pair of lower support arms 310. One having skill in the art and the benefit of the teachings provided herein appreciates that the second pair of lower support arms 310 can have a cross sectional shape that is configured to affect the purpose of the coil deployment trailer system disclosed herein. For example, the second pair of lower support arms 310 can have a cross sectional shape which is substantially rectangular, square, cylindrical, or any other shape known in the art. The second pair of lower support arms 310 can be substantially solid or have a substantially hollow center. One having skill in the art and the benefit of the teachings provided herein appreciates that the second pair of lower support arms 310 can be configured to accommodate similar actuators described herein that operate to shorten or lengthen the first pair of lower support arms 308.

In one or more embodiments, as illustrated in FIGS. 6A and 6B, each lower support arm included in the second pair of lower support arms 310 includes a set of wheels 456 that is utilized to assist in supporting, maneuvering and guiding the coil deployment trailer frame 300 both in the loaded condition (e.g., when the coil 60 of spoolable pipe 12 is mounted within the coil deployment trailer frame 300) and the unloaded condition (e.g., when the coil 60 of spoolable pipe is not mounted on the coil deployment trailer frame 300). In one or more embodiments, the set of wheels 456 is mounted on and disposed at or near the second free end 468 of each lower support arm 310. In other embodiments, the set of wheels 456 is disposed along the length of the second pair of lower support arms 310. The set of wheels 456 can be disposed at any location along the length of each lower support arm 310 such that each set of wheels 456 engages the floor to provide the requisite support, maneuverability, movement and positioning for both a loaded and unloaded coil deployment trailer frame 300. Although each set of wheels 456 as illustrated in FIGS. 6A and 6B includes one (1) wheel, one having ordinary skill in the art will appreciate that each set of wheels 456 can include two (2) wheels, three (3) wheels, four (4) wheels, etc. In one or more embodiments, each set of wheels 456 can include a braking mechanism that utilizes a brake actuator to apply braking forces to the set of wheels 456 to slow the translation of the coil deployment trailer frame 300 in a particular direction across a surface or to completely stop the coil deployment trailer frame 300. In one or more embodiments, the brake actuator can be an electric actuator, a hydraulic actuator, a pneumatic actuator or a type of motor to move the braking mechanism to slow or stop the coil deployment trailer frame 300. For example, a brake pad can be moved towards or away from the set of wheels 456 to apply or disengage a braking force, respectively, to or from the set of wheels 456.

In one or more embodiments, as illustrated in FIGS. 6A and 6B, each of the lower support arms 310 included in the second pair of lower support arms 310 includes a set of wheels 458 disposed along the length of the lower support arm 310. The set of wheels 458 can include one (1) wheel, as illustrated in FIGS. 6A and 6B, or include two (2) wheels, three (3) wheels, etc. In one or more embodiments, each set of wheels 458 is connected to each lower support arm 310 by a bracket 460 that is configured such that the wheels are positioned at a ninety-degree (90°) angle with respect to the lower support arm 310, as illustrated in FIGS. 6A and 6B. Each of the wheels included in the set of wheels 456 is configured to have a diameter such that the engagement surface 462 of each wheel 458 does not contact the ground surface—e.g., to bring the engagement surface 462 of the wheels 458 to a substantially parallel alignment with a ground surface and enable the coil deployment trailer frame 300 to translate across the surface utilizing the set of wheels 458—until the height of the coil deployment trailer frame 300 is reduced to a collapsed position. In one or more embodiments, the set of wheels 458 can be configured as casters such that the set of wheels 458 has the ability to rotate three hundred and sixty degrees (360°) to move in any direction on the ground surface. In one or more other embodiments, the set of wheels 458 can be replaced with supporting feet that operate to sustain the weight of a loaded or unloaded coil deployment trailer frame 300 when the coil deployment trailer frame 300 is in a collapsed position.

In one or more embodiments, the expandable drum assembly 301 may be lowered to a position at or near the ground to secure a coil of spoolable pipe or raised to a position above the ground to collect or dispense a coil of spoolable pipe on or from the expandable drum assembly 301. In one or more embodiments, hydraulic actuators, electric actuators, or a combination of hydraulic and electric actuators are utilized to lower and raise the coil deployment trailer frame 300 to a height that is suitable for securely and interlockingly mounting the expandable drum assembly 301 on the coil deployment trailer frame 300 as disclosed herein. In one or more embodiments, once the expandable drum assembly 301 is securely mounted upon the coil deployment trailer frame 300, hydraulic actuators, electric actuators, pneumatic actuators or a combination of one or more hydraulic, electric and pneumatic actuators can be utilized to lower and raise the expandable drum assembly 301 or the coil of spoolable pipe 12 disposed on the expandable drum assembly 301 to a height such that the spoolable pipe 12 can be securely stored upon, collected to or dispensed from the expandable drum assembly 301.

Figure 6C:
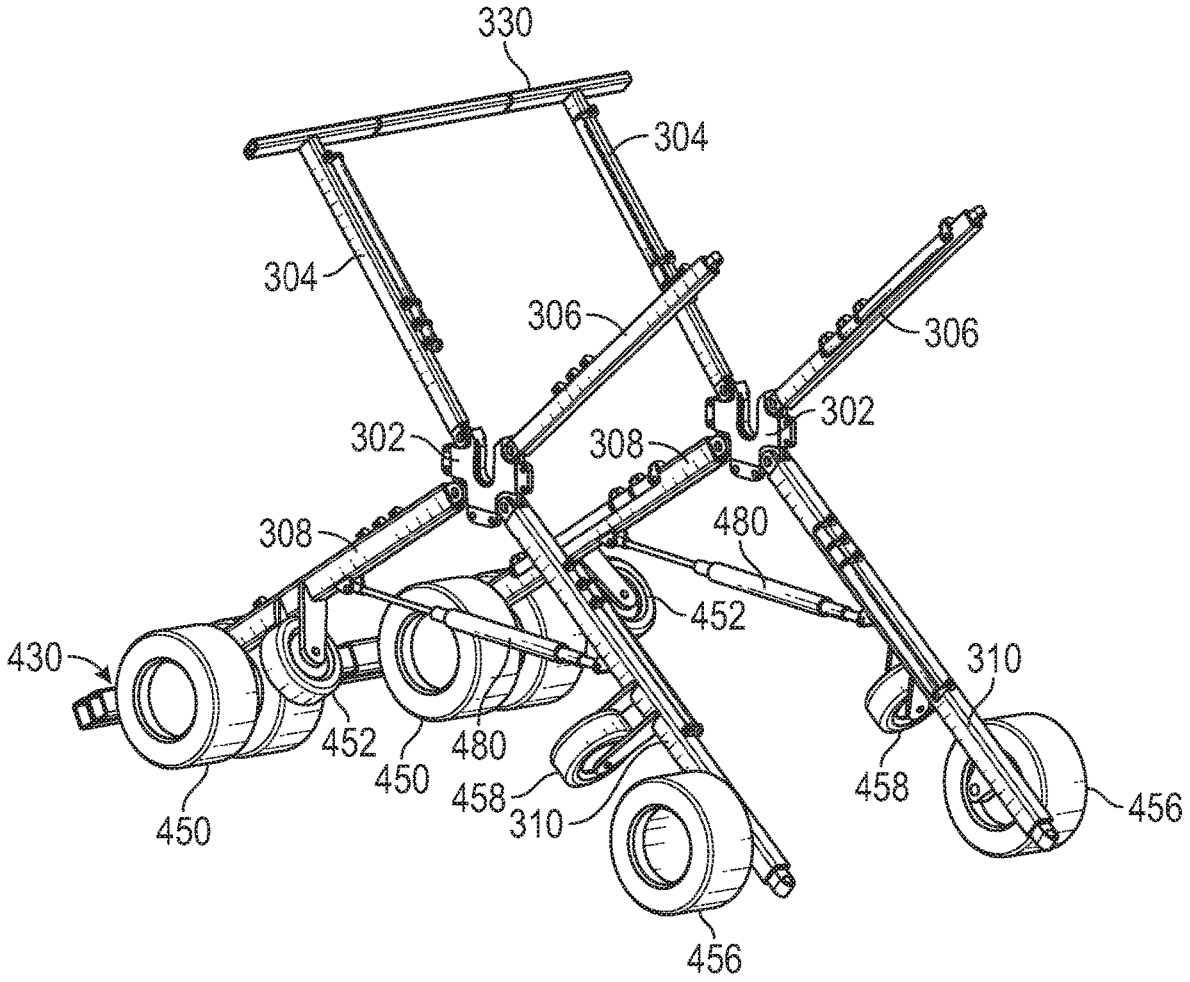
FIG. 6C is a perspective view of an unloaded trailer frame according to one or more embodiments of the present invention.

FIG. 6C illustrates a perspective view of an embodiment of one or more embodiments of the coil deployment trailer system that includes a pair of hydraulic cylinders 480 that are coupled to and secured between the first pair of lower support arms 308 and the second pair of lower support arms 310. The hydraulic cylinders 480 can be used to move the first pair of lower support arms 308 with respect to the second pair of lower support arms 310 (i.e., first pair of lower support arms 308 towards and away from the second pair of lower support arms 310, and vice versa) such that the first and second pair of lower support arms 308,310 pivot about pivotable connections 318 of the respective support brackets 302 to which they are attached. When the hydraulic cylinders 480 are extended such that the first pair of lower support arms 308 and the second pair of lower support arms 310 are moved away from one another, the height of the coil deployment trailer frame 300 is decreased from a height achieved by the coil deployment trailer frame 300 before the hydraulic cylinders 480 were actuated. Similarly, when the hydraulic cylinders 480 are retracted such that the first pair of lower support arms 308 and the second pair of lower support arms 310 are moved towards one another, the height of the coil deployment trailer frame 300 is increased from a height achieved by the coil deployment trailer frame 300 before the hydraulic cylinders 480 were actuated. The hydraulic cylinders 480 are also utilized to provide stability to the coil deployment trailer frame 300, whether the coil deployment trailer frame 300 is in a loaded condition or in an unloaded condition. For example, once the hydraulic cylinders 480 have been actuated to position the first pair of lower support arms 308 with respect to the second pair of lower support arms 310, the first pair of lower support arms 308 and the second pair of lower support arms 310 will no longer be able to pivot about the pivotable connections 318 of the support brackets 302, when the hydraulic cylinders 480 are set in their respective positions, without the further actuation of the hydraulic cylinders 480. In one or more embodiments, the hydraulic cylinders 480 are used in conjunction with a set of pins or other securing elements placed at the respective pivotable connections 318 of the first and second pair of lower support arms 308,310 with respect to the support brackets 302 to assist in securely holding the first and second pair of lower support arms 308,310 in their respective angular positions and help prevent rotation of the first pair of lower support arms 308 and the second pair of lower support arms 310 about the pivotable connections 318. One having skill in the art with the benefit of the teachings provided in the present disclosure appreciates that the set of wheels 450 and the set of wheels 456 are utilized to assist the first pair of lower support arms 308 and the second pair of lower support arms 310 to move with respect to one another when the hydraulic cylinders 480 are actuated in one or more embodiments described herein. The hydraulic cylinders 480 can be utilized in one or more embodiments wherein the first pair of lower support arms 308 and the second pair of lower support arms 310 cannot be telescopically extended as well as one or more embodiments wherein the first pair of lower support arms 308 and the second pair of lower support arms 310 can be telescopingly extended, as discussed herein.

In one or more other embodiments, a second pair of hydraulic cylinders (not shown) can be coupled to and secured between the first pair of upper support arms 304 and the second pair of upper support arms 306 in a similar fashion as the pair of hydraulic cylinders 480 are coupled to and secured between the first pair of lower support arms 308 and the second pair of lower support arms 310, as shown in FIG. 6C. One having skill in the art with the benefit of the teachings provided in the present disclosure appreciates that the second pair hydraulic cylinders can be used to move the first pair of upper support arms 304 with respect to the second pair of upper support arms 306 (i.e., moving the first pair of upper support arms 304 towards and away from the second pair of upper support arms 306, and vice versa) such that the first and second pair of upper support arms 304,306 pivot about pivotable connections 318 of the respective support brackets 302 to which they are attached. When the second pair of hydraulic cylinders are extended such that the first pair of upper support arms 304 and the second pair of upper support arms 306 are moved away from one another, the height of the coil deployment trailer frame 300 is decreased from a height achieved by the coil deployment trailer frame 300 before the second pair of hydraulic cylinders was actuated. Similarly, when the second pair of hydraulic cylinders are retracted such that the first pair of upper support arms 304 and the second pair of upper support arms 306 are moved towards one another, the height of the coil deployment trailer frame 300 is increased from a height achieved by the coil deployment trailer frame 300 before the second pair of hydraulic cylinders was actuated. The second pair of hydraulic cylinders can also be utilized to provide stability to the coil deployment trailer frame 300 whether the coil deployment trailer frame 300 is in a loaded condition or in an unloaded condition. For example, once the second pair of hydraulic cylinders have been actuated to position the first pair of upper support arms 304 with respect to the second pair of upper support arms 306, the first pair of upper support arms 304 and the second pair of upper support arms 306 will no longer be able to pivot about their respective pivotable connections 318 included in the support brackets 302 once the hydraulic cylinders 480 are set in their respective positions without the further actuation of the second pair of hydraulic cylinders. In one or more embodiments, the second pair of hydraulic cylinders are used in conjunction with a set of pins or other securing elements placed at the respective pivotable connections 318 of the first and second pair of upper support arms 304,306 with respect to the support brackets 302 to assist in securely holding the first and second pair of lower support arms 308,310 in their respective angular positions and help prevent rotation of the first pair of upper support arms 304 and the second pair of upper support arms 306 about the pivotable connections 318. Similar to the discussion with respect to the first pair of lower support arms 308 and the second pair of lower support arms 310, the hydraulic cylinders 480 can be utilized in embodiments wherein the first pair of upper support arms 304 and the second pair of upper support arms 306 cannot be telescopically extended as well as embodiments wherein the first pair of upper support arms 304 and the second pair of upper support arms 306 can be telescopingly extended, as discussed herein. In one or more embodiments, the second pair of hydraulic cylinders that are coupled to and secured between the first pair of upper support arms 304 and the second pair of upper support arms 306 are detachably secured to the coil deployment trailer frame 300 such that the hydraulic cylinders are removable during the mounting of the expandable drum assembly 301 to the coil deployment trailer frame 300.

In one or more embodiments, operation of one or more of the first pair of upper support arms 304, second pair of upper support arms 306, first pair of lower support arms 308, second pair of lower support arms 310, coupling assembly 330, horizontal support assembly 430, horizontal containment bar 410 and the pipe re-spooler assembly 342 can be controlled by suitable electrical, pneumatic and/or hydraulic conduits and connectors that terminate in a control housing located within reach of the trailer deployment assembly operator. Preferably, the electrical system controlling the actuators is provided with a controller that functions to lock the actuators in a desired position, such that the position of one or more of the first pair of upper support arms 304, second pair of upper support arms 306, first pair of lower support arms 308, second pair of lower support arms 310, coupling assembly 330, horizontal support assembly 430, horizontal containment bar 410 and the pipe re-spooler assembly 342 can be changed during at any time by an operator and/or pre-determined by data input into the controller by an operator to control the operations of the coil deployment trailer 300. For example, in one or more embodiments, a hydraulic controller is utilized to control the hydraulic pressure in the hydraulic chambers provided in each of the actuators. In one or more other embodiments, a pneumatic controller is utilized to control the pneumatic pressure in the pneumatic chambers provided in each of the actuators. In other embodiments, electro-magnetic actuators can be included in one or more of the first pair of upper support arms 304, second pair of upper support arms 306, first pair of lower support arms 308, second pair of lower support arms 310, coupling assembly 330, horizontal support assembly 430, horizontal containment bar 410 and the pipe re-spooler assembly 342 such that the controller can enable electrical switches to operate the electro-magnetic actuators to attain the proper positioning of one or more of the aforementioned frame components.

For example, if an operator determines that the coil 60 of spoolable pipe 12 is of a particular width in the axial dimension 70 and a particular height in the radial dimension 72, the operator can input the measurements of the width and height into the controller such that the actuators will extend or contract the coupling assembly 330, horizontal support assembly 430, horizontal containment bar 410 and the pipe re-spooler assembly 342, depending upon the original positioning of each of the aforementioned components, to configure the coil deployment trailer frame 300 to accommodate the coil 60 of spoolable pipe 12 that has the predetermined width and height. Once the coil deployment trailer frame 300 has been configured to achieve an appropriate configuration, the coil 60 can be inserted in an interior region disposed between the first pair of upper support arms 304, second pair of upper support arms 306, first pair of lower support arms 308 and second pair of lower support arms 310 to be securely mounted on coil deployment trailer frame 300, as illustrated in FIG. 6B. In other embodiments, one or more of the actuators included in the first pair of upper support arms 304, second pair of upper support arms 306, first pair of lower support arms 308, second pair of lower support arms 310, coupling assembly 330, horizontal support assembly 430, horizontal containment bar 410 and the pipe re-spooler assembly 342 are controlled by manual means, such as a hand crank jack, foot-operated jack, screw jack, or some other type of manually operated device that operates to supply hydraulic, pneumatic or electro-magnetic forces to the respective actuators utilized in each of the aforementioned components, and other telescoping components described herein.

In one or more embodiments, once the required width of the coil deployment trailer frame 300 to mount a coil 60 of spoolable pipe 12 is determined, the horizontal support assembly 430 is controlled such that the telescoping horizontal telescoping support bar 432 is, or both the first and second horizontal telescoping support bars 432 and 434, depending upon the configuration of the coil deployment trailer frame 300, are expanded via the utilization of one or more actuators, as described herein, such that the coil deployment trailer frame 300 assumes a suitable width to accommodate the coil 60 of spoolable pipe 12. In one or more embodiments, if the one or more of the coil deployment trailer frame 300 frame components, including the coupling assembly 330, horizontal containment bar 410 and the pipe re-spooler assembly 342, do not include actuators, these frame components automatically extend to the proper width dimension when the horizontal support assembly 430 is extended as the telescoping bars included in each of these frame components are free to move relative to one another to expand and retract the respective frame components. In other embodiments, if one or more of the coupling assembly 330, horizontal containment bar 410 and the pipe re-spooler assembly 342 include actuators, then the respective actuators included in the frame components will operate to adjust the frame components to assume the desired width along with the horizontal support assembly 430 such that the coil deployment trailer frame 300 is configured to accommodate the coil 60 of spoolable pipe 12.

In one or more embodiments, once a width of the coil deployment trailer frame 300 relative to the first pair of upper support arms 304, second pair of upper support arms 306, first pair of lower support arms 308 and second pair of lower support arms 310 (e.g., the distance between the support brackets 302) has been achieved, one or more of the frame components, including, for example, the coupling assembly 330, horizontal support assembly 430, horizontal containment bar 410 and the pipe re-spooler assembly 342 can be locked into place via the respective actuators such that the trailer will remain rigid to perform the desired functions.

In one or more other embodiments, locking screws, securement pins or similar means can be provided on the first pair of upper support arms 304, second pair of upper support arms 306, first pair of lower support arms 308, second pair of lower support arms 310, coupling assembly 330, horizontal support assembly 430, horizontal containment bar 410 and the pipe re-spooler assembly 342 as a primary or back-up securing system to lock each one of the aforementioned trailer frame components in place such that the length of each of the aforementioned frame components is set. Utilizing the locking screws, securement pins or similar means, the position of the male telescoping bars with respect to each of the female telescoping members included in each of the first pair of upper support arms 304, second pair of upper support arms 306, first pair of lower support arms 308, second pair of lower support arms 310, coupling assembly 330, horizontal support assembly 430, horizontal containment bar 410 and the pipe re-spooler assembly 342 can be further secured during use. Although one or more of the frame components included in one or more embodiments of the coil deployment trailer frame 300, frame components including the first pair of upper support arms 304, second pair of upper support arms 306, first pair of lower support arms 308, second pair of lower support arms 310, coupling assembly 330, horizontal support assembly 430, horizontal containment bar 410 and the pipe re-spooler assembly 342, include extendable and retractable male and female telescoping bars, one having ordinary skill in the art with the benefit of the teachings provided herein appreciates that the one or more frame components can include a rod and channel configuration, a track and rail configuration, or any other suitable extendable and retractable configurations known in the art to allow the width and the height of the frame components to be adjusted relative to one another. For example, in one or more embodiments, one or more frame components can include high load capacity and reduced deflection telescopic rails with linear slides with inductively hardened raceways and caged balls bearings. In operation, these high load capacity and reduced deflection telescopic rails can be extended OF retracted using one or more of the actuators described herein, or manually by personnel, and exhibit little deflection while under heavy loads.

With respect to coil deployment trailer frame 300, to use one or more embodiments of the coil deployment trailer system to store or dismount an empty expandable drum assembly 301, mount an unloaded expandable drum assembly 301, or mount a loaded expandable drum assembly 301 that includes a coil 60 of spoolable pipe 12 disposed on the expandable drum assembly 301, the height of coil deployment trailer frame 300 can be adjusted for its intended purpose. For example, the coil deployment trailer frame 300 can be collapsed to a height such that an empty expandable drum assembly 301 that has deployed all of the spoolable pipe 12 can be stored or dismounted. In one or more embodiments, the coil deployment trailer system operator initiates actuators to collapse the coil deployment trailer frame 300 to a height such that the wheels 452 disposed on the first pair of lower support arms 308 and the wheels 458 disposed on the second pair of lower support arms 310 the coil deployment trailer frame 300 make contact with the ground surface. In one or more embodiments, the hydraulic cylinders 480 are utilized to move the first pair of lower support arms 308 and the second pair of lower support arms 310 away from one another such that the first and second pair of lower support arms 308,310 pivot about their respective pivotable connections 318 to achieve a position wherein the wheels 452 disposed on the first pair of lower support arms 308 and the wheels 458 disposed on the second pair of lower support arms 310 are in contact with the ground surface.

When the coil deployment trailer frame 300 is in a collapsed position, the set of wheels 450 disposed on each lower support arm included in the first set of lower support arms 308 and the set of wheels 456 disposed on each lower support arm included in the second set of lower support arms 310 are disposed above the ground surface such that they are not in contact with the ground surface. When the coil deployment trailer frame 300 is in a collapsed configuration, the wheels 452 disposed on the first pair of lower support arms 308 and the wheels 458 disposed on the second pair of lower support arms 310 are in contact with the ground surface and, as such, can be utilized to manipulate and translate the coil deployment trailer frame 300 across the ground surface to position the coil deployment trailer frame 300 such that the expandable drum assembly 301 or the reel 44 can be dismounted therefrom, or stored thereon. During this operation, the first pair of upper support arms 304 and the second pair of upper support arms 306 are each pivotably adjusted at their respective pivotable connections 318 included in the support brackets 302 such that the first and second pair of upper support arms 304,306 extend outwardly from the supporting bracket 302 in substantially opposing directions to achieve angular positions that enable the expandable drum assembly 301 or the reel 44 to be mounted to or dismounted from the coil deployment trailer frame 300. In one or more embodiments, hydraulic cylinders are utilized to move the first pair of upper support arms 304 and the second pair of upper support arms 306 away from one another to achieve angular positions that enable the expandable drum assembly 301 or the reel 44 to be mounted to or dismounted from the coil deployment trailer frame 300. In one or more other embodiments, pins or other mechanical means and implements, as described herein, are utilized to secure the first pair of upper support arms 304 and the second pair of upper support arms 306 in their respective positions. In one or more of these embodiments, the first and second pair of upper support arms 304,306 may be manually adjusted to the requisite positions such that the expandable drum assembly 301 or the reel 44 to be mounted to or dismounted from the coil deployment trailer frame 300.

In one or more embodiments, the width of the coil deployment trailer frame 300 can be adjusted when the coil deployment trailer frame 300 is in a collapsed position. To adjust the width of the coil deployment trailer frame 300, the length of the horizontal support assembly 430 is adjusted utilizing actuators, as described herein. In one or more embodiments, the male and female telescoping components included in each of the coupling assembly 330, horizontal containment bar 410 and the pipe re-spooler assembly 342 are free to move with respect to another, as discussed herein, to obtain the proper length, respectively, in response to the axial expansion or contraction of the horizontal support assembly 430. In one or more embodiments, the male and female telescoping components, included in each of the coupling assembly 330, horizontal containment bar 410 and the pipe re-spooler assembly 342, include enough resistance with respect to one another such that their respective configurations (e.g., lengths and axial positions) will be maintained to carry out their respective functions. In one or more other embodiments, securement pins, positioning screws, or some other means known by those having skill in the art can be utilized to maintain the length of the coupling assembly 330, horizontal containment bar 410 and the pipe re-spooler assembly 342 once the width of the horizontal support assembly 430 is achieved. In one or more other embodiments, actuators are utilized to extend or retract the male and female telescoping components included in each of the coupling assembly 330, horizontal containment bar 410 and the pipe re-spooler assembly 342 frame components such that the frame components are lengthened/shortened and stabilized such that the coil deployment trailer frame 300 can achieve the desired width. In one or more embodiments, the male and female telescoping components included in each of the horizontal support assembly 430, coupling assembly 330, horizontal containment bar 410 and the pipe re-spooler assembly 342 can be manually moved with respect to another, as discussed herein, to obtain the proper length such that the coil deployment trailer frame 300 can achieve the desired width.

In one or more embodiments, an operator of the coil deployment system can automatically configure the coil deployment trailer frame 300 to accommodate a coil 60 of spoolable pipe 12 of a predetermined width by inputting the width of the coil 60 into a controller (e.g., hydraulic controller, pneumatic controller, electro/magnetic controller, or any suitable controller that operates to control the respective actuators utilized in the coil deployment trailer frame 300 to actuate the requisite frame components included therein) which, in turn, will control the actuators to manipulate the frame components to achieve the desired configuration such that the coil 60 of spoolable pipe can be mounted to or unmounted from the coil deployment trailer frame 300. In these embodiments, each of the actuators, that operate to extend the male and female telescoping components included in the horizontal support assembly 430, are controlled to extend or retract, as described herein, such that a width of the trailer assembly that is suitable to accommodate the expandable drum assembly 301 is achieved. In one or more embodiments, actuators in one or more of the coupling assembly 330, horizontal containment bar 410 and the pipe re-spooler assembly 342 are also controlled to extend or retract, as described herein, such that a width of the coil deployment trailer frame 300 that is suitable to accommodate the expandable drum assembly 301 is achieved. In other embodiments, once an operator inputs the desired width of the coil deployment trailer frame 300 into the controller, the male and female telescoping components included in each of the coupling assembly 330, horizontal containment bar 410 and the pipe re-spooler assembly 342 are free to move with respect to another, as discussed herein, to obtain the proper length, respectively, in response to the axial expansion or retraction of the horizontal support assembly 430.

In one or more embodiments, the pair of wheels 452 and the pair of wheels 458 engage the ground surface upon which the coil deployment trailer frame 300 rests and are utilized to move the trailer frame along the ground surface such that the expandable drum assembly 301 is positioned between the first pair of upper support arms 304, the second pair of upper support arms 306, the first pair of lower support arms 308 and the second pair of lower support arms 310. In one or more embodiments, the horizontal containment bar 410 is removable such that the trailer frame can be positioned around the expandable drum assembly 301. Once the expandable drum assembly 301 is properly positioned such that the coil 60 of spoolable pipe 12 is within an interior space between the first pair of upper support arms 304, the second pair of upper support arms 306, the first pair of lower support arms 308 and the second pair of lower support arms 310, and the inner engagement surfaces of the support brackets 302 are aligned with the first hub shaft 305 included in the first hub 303 and the second hub shaft included in the second hub of the expandable drum assembly 301, the coil deployment trailer frame 300 is raised by extending the first pair of lower support arms 308 and the second pair of lower support arms 310 such that the inner engagement surfaces 314 included in each support bracket 302 engages the first hub shaft 305 included in the first hub 303 and the second hub shaft included in the second hub of the expandable drum assembly 301, respectively, as illustrated in FIG. 6B. In other embodiments, the expandable drum assembly 301 can be hoisted onto the coil deployment trailer frame 300 utilizing a hoist, crane or other suitable lifting means (e.g., overhead crane, lift, mobile crane, pulley, etc.) via the first and second hub shafts 305,309 included in their respective first and second hubs 303,307. Once the first hub shaft 305 and the second hub shaft are disposed within the respective inner engagement surfaces 314 included in the hub engagement sections 312, the hub securement latches 316 are latched to securely and interlockingly engage the expandable drum assembly 301 such that, once the expandable drum assembly 301 is lifted to a proper height, the expandable drum assembly 301 is restrained in the axial direction 62 and the radial direction 64 while free to rotate in the circumferential direction 66. Accordingly, the coil deployment trailer frame 300 of the coil deployment system is configured to deploy, collect, store and transport coils 60 of spoolable pipe that have various heights of up to 16 feet in their outer diameter, and widths of up to 12 to 15 feet depending upon the configuration of the coil deployment trailer.

In one or more embodiments, an operator of the coil deployment system can automatically configure the coil deployment trailer frame 300 to accommodate a coil 60 of spoolable pipe 12 of a predetermined width by inputting the width of the coil 60 into the controller which, in turn, will control the actuators to manipulate the frame components to achieve the desired configuration such that the coil 60 of spoolable pipe can be mounted to the coil deployment trailer frame 300. In one or more embodiments, an operator of the coil deployment system can automatically configure the coil deployment trailer frame 300 to accommodate the coil 60 of spoolable pipe 12 of a predetermined height by inputting the height of the coil 60 into the controller which, in turn, will control the actuators to manipulate the frame components to achieve the desired configuration such that the coil 60 of spoolable pipe can be mounted to the coil deployment trailer frame 300. Alternatively, the actuators can be manually controlled, as discussed herein, to manipulate the frame components such that the coil deployment trailer frame 300 is configured to accommodate a coil 60 of a certain width and a certain height such that the coil 60 of spoolable pipe can be mounted to the coil deployment trailer frame 300.

As is seen with respect to FIG. 6B, the first pair of upper support arms 304 are positioned (e.g., lengthened through extension or retracted) such that the cylindrical elongated members 360 and 362 of the pipe re-spooler assembly 342 engage the outermost layers of coil of spoolable pipe 12 included in the coil 60 when the expandable drum assembly 301 is loaded with a coil 60 of spoolable pipe 12. The second pair of upper support arms 306 are positioned (e.g., lengthened through extension or retracted) such that the horizontal containment bar 410 is properly aligned with the surface of the coil 60, such that the undeployed pipe included in the coil 60 of spoolable pipe 12 is contained within the boundaries of the coil deployment trailer frame 300 during deployment and collection of the spoolable pipe.

Once the expandable drum assembly 301 is properly mounted in the coil deployment trailer frame 300 such that the expandable drum assembly 301 is securely and interlockingly disposed in the support brackets 302, the coil deployment trailer frame 300 is raised to a suitable height such that the spoolable pipe 12 can be collected, dispensed, stored or transported, depending upon the operation that the operator of the coil deployment trailer system desires to perform. In one or more embodiments, an operator of the coil deployment system can automatically configure the coil deployment trailer frame 300 to deploy, store or collect spoolable pipe 12 from, upon or to, respectively, the coil 60 that has a predetermined height in the radial direction thereof. In these embodiments, the operator will input the height of the coil or a height which the coil 60 will achieve in some time in the future and the controller will, in turn, control the actuators to manipulate the relevant frame components to achieve the desired configuration such that the coil 60 of spoolable pipe can be deployed, stored, or collected from, upon or to, respectively, the coil 60 securely mounted on the coil deployment trailer frame 300. Alternatively, the actuators can be manually controlled, as discussed herein, to manipulate the frame components such that the coil deployment trailer frame 300 is configured to manipulate the coil 60 to perform a desired operation. During the process of collecting or deploying spoolable pipe 12 to or from the coil 16, respectively, the coil deployment trailer frame 300 is configured such that the expandable drum assembly 301 can rotate in a circumferential direction 66 about its axis. For example, when the coil deployment trailer frame 300 is being utilized to collect spoolable pipe 12, the first hub shaft 305 and the second hub shaft are free to rotate within the respective support brackets 302 such the expandable drum assembly 301 rotates in a direction to collect spoolable pipe 12 to add the pipe 12 to the coil 60. When the coil deployment trailer frame 300 is being utilized to deploy spoolable pipe 12, the first hub shaft 305 and the second hub shaft are free to rotate within the respective support brackets 302 such the expandable drum assembly 301 rotates in a direction to deploy the spoolable pipe 12 to remove the pipe 12 from the coil 60. During any of the aforementioned operations, if the coil deployment trailer frame 300 is in a raised position as shown in FIGS. 6A-6C, such that the pair of wheels 452 disposed on the first set of lower support arms 308 and the pair of wheels 458 disposed on the second set of lower support arms 310 are raised off of the ground surface, the coil deployment trailer frame 300 can translate across the ground surface utilizing the set of wheels 450 disposed on the first pair of lower support arms 308 and the set of wheels 456 disposed on the second pair of lower support arms 310. If the trailer frame is in a collapsed position such that the pair of wheels 452 and the pair of wheels 458 are lowered to engage the ground surface, the coil deployment trailer frame 300 can translate across the ground surface utilizing the pair of wheels 452 disposed on the first pair of lower support arms 308 and the pair of wheels 458 disposed on the second pair of lower support arms 310.

The coil deployment trailer frame 300 can also be transported utilizing a towing vehicle, such as a truck, tractor or other suitable vehicle that can move along a ground surface to tow the coil deployment trailer frame 300 behind the vehicle. In one or more other embodiments, the coil deployment trailer frame 300 can be pushed utilizing a suitable vehicle that can operate to push the coil deployment trailer frame 300 across a ground surface. The coil deployment trailer frame 300 is configured such that the coil deployment trailer frame 300 can be towed or pushed when the trailer frame is in a collapsed configuration, or when the coil deployment trailer frame 300 is raised, as shown in FIG. 6B. In one or more embodiments, the horizontal support assembly 430, coupling assembly 330, and/or horizontal containment bar 410 includes a towing or pushing mechanism, such as a series of hooks, ball joints, mating components configured to engage respective mating elements disposed on a towing or pushing vehicle. In one or more embodiments, other towing components, that attach to one or more of the horizontal support assembly 430, coupling assembly 330, and/or horizontal containment bar 410 and operate to matingly and interlockingly engage respective towing or pushing elements disposed on a towing or pushing vehicle, can be utilized. In these embodiments, once the towing or pushing mechanism attached to the horizontal support assembly 430, coupling assembly 330, and/or horizontal containment bar 410 are interlockingly and matingly engaged to the respective towing or pushing elements disposed on a towing or pushing vehicle, the coil deployment trailer frame 300 can either be towed or pushed, depending upon the connection, to transport, collect or dispense spoolable pipe disposed on the coil 60.

While the present disclosure has been described with respect to a limited number of embodiments, those skilled in the art, having benefit of this disclosure, will appreciate that other embodiments may be devised which do not depart from the scope of the disclosure as described herein. For example, the expandable drum assembly 301, utilized in the embodiments of the coil deployment system that include the coil deployment trailer frame 300 described above, can be replaced by the reel 44. Furthermore, for example, one or more embodiments of the coil deployment trailer system, discussed with reference to FIGS. 17-20, that includes the coil deployment trailer frame 500 that is configured to deploy, collect, store and transport coils 60 of spoolable pipe, disposed on the expandable drum assembly 301 or reel 44 that have various heights of up to 16 feet in their outer diameter, and widths of up to 12 to 15 feet, are disclosed herein.

Figure 7:
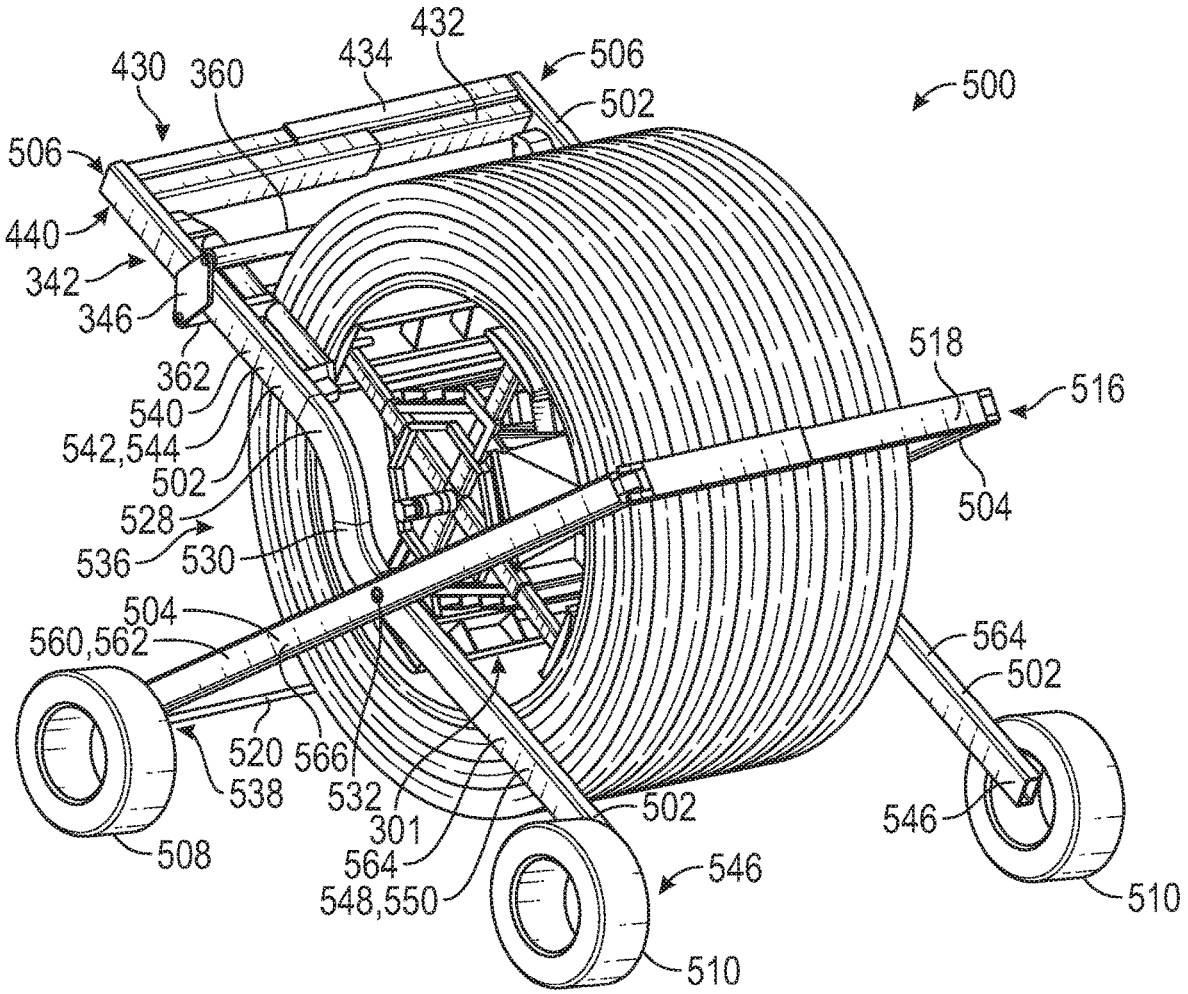
FIG. 7 is a perspective view of a trailer frame with a drum assembly loaded with a coil of pipe mounted on the trailer frame according to one or more embodiments of the present invention.
Figure 8:
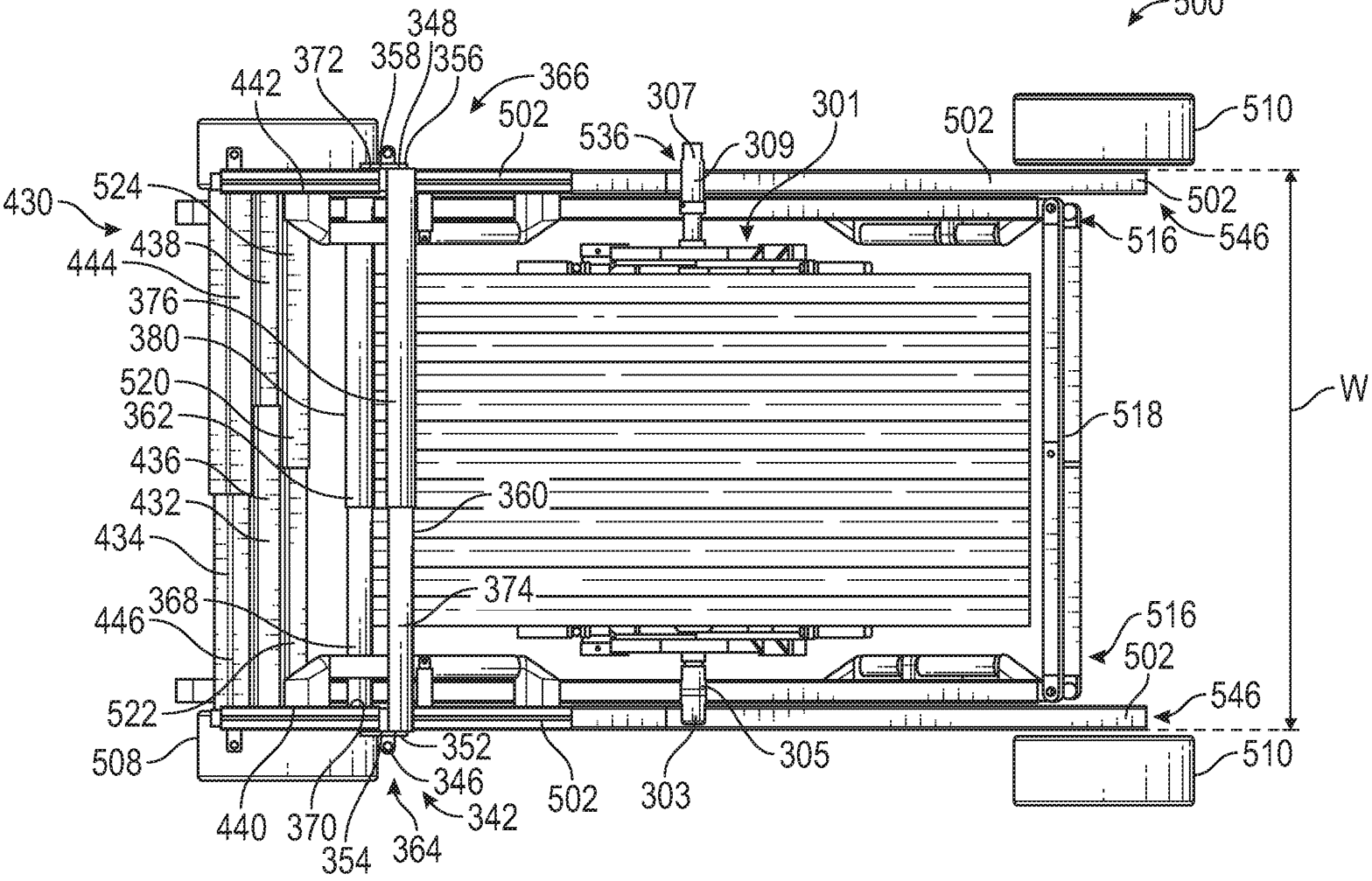
FIG. 8 is a top view of a trailer frame with a drum assembly loaded with a coil of pipe mounted on the trailer frame according to one or more embodiments of the present invention.

FIG. 7 illustrates a perspective view of an embodiment of the coil deployment trailer frame 500. As shown in FIG. 7, the coil deployment trailer frame 500 generally includes the first pair of trailer frame support arms 502 and the second pair of trailer supports arms 504. Each of the trailer support arms included in the first pair of trailer support arms 502 includes a first end 506 connected to the horizontal support assembly 430 and a second end 546 connected to a set of wheels 510. One having skill in the art and the benefit of the teachings provided herein appreciates that, in one or more embodiments, the horizontal support assembly 430 can be disposed between the second ends 538 of the second set of trailer support arms 504. One having skill in the art and the benefit of the teachings provided herein also appreciates that the horizontal support assembly 430 includes horizontal telescoping bars 432 and 434 that are operable to adjust the width of the coil deployment trailer frame 500 in a similar manner as the horizontal support assembly 430 is operable adjust to adjust the width of the coil deployment trailer frame 300, as described herein, to accommodate coils 60 of various widths 70. Although FIG. 7 illustrates the horizontal support assembly 430 to include two horizontal telescoping bars 432 and 434, one having skill in the art with the benefit of this disclosure will appreciate that the horizontal support assembly 430 can include one, three, four or more horizontal telescoping bars that are operable to adjust the width of the coil deployment trailer frame 500, as described herein, to accommodate coils 60 of various widths 70.

As shown in FIG. 7, each of the trailer support arms included in the second pair of trailer support arms 504 includes a first end 516 connected to a horizontal containment bar 518. In one or more embodiments, the horizontal containment bar 518 is configured and operates in a similar manner as the horizontal containment bar 410 described with respect to one or more embodiments of the coil deployment trailer frame 300. The second pair of trailer support arms 504 each includes a second end 538 connected a coupling assembly 520. In one or more embodiments, the coupling assembly 520 is configured and operates in a similar manner as the coupling assembly 330 described with respect to one or more embodiments of the coil deployment trailer frame 300. For example, as best seen with respect to FIG. 8, one or more embodiments of the coupling assembly 520 includes pair of telescoping bars including a male telescoping bar 522 and a female telescoping bar 524 that are slidably connected to one another and configured to translate in a telescoping manner when the length of the horizontal support assembly 430 is adjusted. Each of the trailer support arms included in the second pair of trailer support arms 504 includes a set of wheels 508 disposed at or near the second end 538 the trailer support arms 504 along the length of the trailer support arms 504. Although each set of wheels 508 illustrated in FIG. 7 includes one (1) wheel, one having skill in the art will appreciate that the set of wheels 508 can include two (2) wheels, three (3) wheels or more, depending upon the configuration of the coil deployment trailer frame 500 required. The re-spooler assembly 342 included in coil deployment trailer frame 500 has been disclosed herein and, as such, will not be described again with respect to coil deployment trailer frame 500 in detail. One having skill in the art with the benefit of the teachings herein will appreciate that the re-spooler assembly 342 is disposed on the length of the first pair of trailer support arms 504 and is configured to facilitate the collection of spoolable pipe 12 around the expandable drum assembly 301, the deployment of spoolable pipe 12, the slowing of the rotation of the expandable drum assembly 301, or the stopping of the rotation of the expandable drum assembly 301 when spoolable pipe 12 is being deployed or collected.

The first pair of support arms 502 is connected to the second pair of support arms 504 via pivotable connections 532. One having skill in the art and the benefit of the teachings provided herein appreciates that pivotable connections 532 can include ball joint connections, pins, ball bearing assemblies, screws, bolts, bolt and nut assemblies, or other connections that allow for a secure and rotatable connection between the first pair of support arms 502 and the second pair of support arms 504. As shown in FIG. 7, each of the trailer support arms included in the second pair of trailer support arms 504 is substantially straight along the length of each trailer support arms 504 disposed between the horizontal containment bar 518 and the coupling assembly 520. Each of the trailer support arms included in the first pair of trailer support arms 502 includes an inwardly curved section 528 disposed along the length of each trailer support arms 502. Furthermore, each of the trailer support arms included in the first pair of trailer support arms 502 includes an outwardly curved section 530 disposed along the length of each trailer support arms 502 that is connected to the inwardly curved section 528. Hub engagement sections 536 are disposed on lateral sides of the coil deployment trailer frame 500 and above pivotable connections 532.

The hub engagement sections 536 are formed at or near the intersections of the outwardly curved sections 530 and the second pair of trailer arms 504, and are configured to rotatably secure respective hub shafts 305 and 309 included in first and second hubs 303,307 of the expandable drum assembly 301. The first pair of trailer support arms 502 and the second pair of trailer support arms 504 operate to secure the expandable drum assembly 301 by securing the first hub shaft 305 and the second hub shaft 309 (best shown in FIG. 8) of the expandable drum assembly 301 just above the intersection of each trailer support arm 504 and each trailer support arm 502 within hub engagement sections 536. One having skill in the art and the benefit of the teachings provided herein appreciates that hub engagement sections 536 are configured to rotatably secure the hub shafts of the expandable drum assembly 301 such that coils 60 of spoolable pipe 12 can be deployed, collected, transported or stored. In one or more embodiments, the hub engagement sections 536 are configured in a similar manner as the hub engagement sections 312, included in coil deployment trailer frame 300, in that the hub engagement sections 536 include an engagement surface (e.g., substantially u-shaped or some other shape that is suitable to rotatably engage the first and second hub shafts 305,309) and a latch (not shown). In one or more embodiments, the first hub shaft 305 and the second hub shaft 309 are rotatably and interlockingly secured within the respective hub engagement sections 536. In one or more embodiments, the weight of the expandable drum assembly 301, in the case of an empty expandable drum assembly 301, or the weight of the coil 60 of spoolable pipe 12 loaded on the expandable drum assembly 301 operates to prevent the expandable drum assembly 301 from moving in a radial direction 64 (e.g., up and down) apart from the movement of the coil deployment trailer frame 500 while the expandable drum assembly 301 is deploying spoolable pipe 12, collecting spoolable pipe 12, or is being stored on the collapsed coil deployment trailer frame 500. In one or more other embodiments, the securing latch is provided such that the first hub shaft 305 and the second hub shaft 309 are pivotably and radially secured such that the expandable drum assembly 301 can pivot around the axes of the first hub shaft 305 and the second hub shaft 309 while being constrained in the radial direction 64 (e.g., the up and/or down direction). In particular, one having skill in the art with the benefit of the teachings provided the present disclosure appreciates that one or more other securing components known to those having skill in the art can be utilized to secure and stabilize expandable drum assembly 301 within hub engagement section 536.

In one or more embodiments, the first pair of support arms 502 and the second pair of support arms 504 are of a fixed length such that the height of the coil deployment trailer frame 500 is varied by changing the angular positions of each of the support arms 502 and 504 with respect to one another about a corresponding pivotable connections 532 to which support arms 502 and 504 are connected. In this manner, the height of the coil deployment trailer frame 500 can be changed to accommodate and manipulate coils 60 of spoolable pipe 12 of different radial dimensions 72 (e.g., a radial dimension 72 of the coil 60 is based on the diameter of the pipe and the number and radial 64 position of the wraps forming the coil 60) within the coil deployment trailer frame 500.

In one or more other embodiments, each of the trailer support arms included in the first pair of trailer support arms 502 includes a telescoping extension arm 540 that extends between the first end 506 of the first pair of trailer support arms 502 and the first section 528 of drum assembly hub engagement sections 536. The telescoping extension arms 540 each include a male telescoping bar 542 and a female telescoping bar 544 and operate in a similar manner to the telescoping bars included in the coil deployment trailer frame 300 to adjust the length of the first pair of upper support arms 304. In one or more embodiments, the telescoping extension arms 540 include actuators to adjust the length of the first pair of trailer support arms 502. In other embodiments, the length of the first pair of trailer support arms 502 can be adjusted by a controller, manually adjusted or adjusted by mechanical means as described herein with respect to the first pair of upper support arms 304 included in the coil deployment trailer frame 300.

In one or more embodiments, each of the trailer support arms included in the first pair of trailer support arms 502 further includes a telescoping extension arm 564 that extends between the second end 546 of the first pair of trailer support arms 502 and the pivotable connections 532. The telescoping extension arms 564 each include a male telescoping bar 548 and a female telescoping bar 550 and operate in a similar manner to the telescoping bars included in the each of the first pair of lower support arms 308 included in the pair of lower support arms 308 included in coil deployment trailer frame 300 to adjust the length of the telescoping extension arms 564 to, thereby, adjust the height of the coil deployment trailer frame 500. In one or more embodiments, the telescoping extension arms 564 include actuators to adjust the length of the telescoping extension arms 564. In other embodiments, the length of the telescoping extension arms 564 can be adjusted by a controller (hydraulic, pneumatic, magnetic, electro-magnetic, or combination of one or more of the aforementioned), manually or by mechanical means as described herein with respect to the pair of lower support arms 308 included in coil deployment trailer frame 300.

In one or more embodiments, each of the trailer support arms included in the second pair of trailer support arms 504 includes a telescoping extension arm 552 that extends between the first ends 516 of the second pair of trailer support arms 504 and the pivotable connections 532. The telescoping extension arms 552 each include a male telescoping bar 554 and a female telescoping bar 556 and operate in a similar manner to the telescoping bars included in first pair of upper support arms 304 included in the coil deployment trailer frame 300 to adjust the length of the second pair of trailer support arms 504. In one or more embodiments, the telescoping extension arms 552 include actuators to adjust the length of the second pair of trailer support arms 504. In other embodiments, the length of the second pair of trailer support arms 504 can be adjusted by the controller, manually or by mechanical means as described herein with respect to the first pair of upper support arms 304 included in the coil deployment trailer frame 300.

In one or more embodiments, each of the trailer support arms included in the second pair of trailer support arms 504 further includes a telescoping extension arm 566 that extends between the second end 538 of the second pair of trailer support arms 504 and the pivotable connections 532. The telescoping extension arms 564 each include an upper male telescoping bar 560 and a lower female telescoping bar 562 and operate in a similar manner to the telescoping bars included in the each of the lower support arms 310 included in the pair of lower support arms 310 included in coil deployment trailer frame 300 to adjust the length of the telescoping extension arms 564 to, thereby, adjust the height of the coil deployment trailer frame 500. In one or more embodiments, the telescoping extension arms 564 include actuators to adjust the length of the telescoping extension arms 564. In other embodiments, the length of the telescoping extension arms 564 can be adjusted by the controller, manually or by mechanical means as described herein with respect to the pair of lower support arms 310 included in coil deployment trailer frame 300.

Similar to the hydraulic cylinders 480 described with respect to one or more embodiments of the coil deployment trailer frame 300, one or more embodiments of the coil deployment trailer frame 500 includes a pair of hydraulic cylinders (not shown) that are coupled to and secured between each of the first pair of trailer support arms 502 and the second pair of trailer support arms 504 at positions above the pivotable connection 532. For example, if the first and second pair of trailer support arms 502,504 are telescopingly extendable, as discussed herein with respect to one or more embodiments, then the pair of hydraulic cylinders can be disposed between telescoping extension arms 564, of the first pair of trailer support arms 502, and the telescoping extension arms 566 of the second pair of trailer support arms 504. In one or more embodiments, the hydraulic cylinders can also be coupled to and secured between each of the first pair of trailer support arms 502 and the second pair of trailer support arms 504 at similar positions, wherein the first and second pair of trailer support arms 502,504 do not have telescoping functionality such that they are fixed in their respective lengths. One having skill in the art with the benefit of the teachings provided the present disclosure appreciates that the hydraulic cylinders included in certain embodiments of the coil deployment trailer frame 500 operate to raise and lower the coil deployment trailer frame 500, and pivotably secure the first pair of trailer support arms 502 and the second pair of trailer support arms 504 about the pivotable connections 532. The hydraulic cylinders of these certain embodiments can also be utilized to provide stability to the coil deployment trailer frame 500 once the hydraulic cylinders have been actuated to position the first pair of trailer support arms 502 with respect to the second pair of trailer support arms 504 as the first pair of trailer support arms 502 and the second pair of trailer support arms 504 will no longer be able to pivot about the pivotable connections 532 without the further actuation of the hydraulic cylinders. In one or more embodiments, a set of pins or other securing elements are utilized and placed at the respective pivot points of the first pair of trailer support arms 502 and the second pair of trailer support arms 504 with respect to the pivotable connections 532 to assist in securely holding the first and second pair of trailer support arms 502,504 in their respective angular positions and help prevent rotation of the first and second pair of lower trailer support arms 502,504 about the pivotable connections 532. One having skill in the art with the benefit of the teachings provided in the present disclosure appreciates that the set of wheels 510 and the set of wheels 508 are utilized to assist the first and second pair of lower trailer support arms 502,504 to move with respect to one another when the hydraulic cylinders are actuated. In one or more other embodiments, a second pair of hydraulic cylinders (not shown) can also be disposed between the first and second pair of trailer support arms 502,504 at positions above the pivotable connection 532, in a similar configuration and to operate in a similar manner as the second pair hydraulic cylinders disposed between the first and second pair of upper support arms 304,306 included in one or more embodiments of the coil deployment trailer frame 300.

FIG. 8 illustrates a top view of an embodiment of the coil deployment trailer frame 500. The expandable drum assembly 301 is disposed on the coil deployment trailer frame 500 and supported by the first hub shaft 305 of the first hub 303 and the second hub shaft 309 at the second hub 307 at the respective hub engagement sections 536. The hub engagement sections 536 are configured such that the first hub shaft 305 and the second hub shaft 309 can rotate about the axial axis 62 of the expandable drum assembly 301 such that the expandable drum assembly 301 can rotate while spoolable pipe 12 is being deployed from or collected to the expandable drum assembly 301. Again, as shown in FIG. 8, the coil deployment trailer frame 500 includes the horizontal support assembly 430, horizontal containment bar 518, pipe respooler assembly 342, and coupling assembly 520. Although the expandable drum assembly 301 loaded with a coil 60 of a particular width and height is illustrated, the coil deployment trailer frame 500 is configured to vary in width W via actuation of the horizontal support assembly 430.

As discussed herein with respect to the coil deployment trailer frame 300, the width W of the coil deployment trailer frame 500 can be changed by extending and retracting the length of the horizontal support assembly 430. For example, if the coil deployment trailer frame 500 is configured such that the coil deployment trailer frame 500 has a first width W1, the width W of the coil deployment trailer frame 500 can be lessened to width W minus a length (X) to achieve a new width W−X. To achieve the new width W−X, the horizontal support assembly 430 is retracted using one or more actuators, as described herein, to reduce the length of the of the horizontal support assembly 430. In one or more embodiments, the retraction of the horizontal support assembly 430 also automatically causes each of the horizontal containment bar 518, pipe re-spooler assembly 342 and coupling assembly 520 to also retract such that the length of each of the horizontal containment bar 518, pipe re-spooler assembly 342 and coupling assembly 520 is reduced until the width W−X of the coil deployment trailer frame 500 is achieved. Similarly, if the coil deployment trailer frame 500 is configured such that the coil deployment trailer frame 500 has a first width W, the width W of the coil deployment trailer frame 500 can be increased to W plus a length (Y) to achieve a new width W+Y. To achieve the new width W+Y, the horizontal support assembly 430 is expanded using one or more actuators, as described herein, to increase the length of the of the horizontal support assembly 430. In one or more embodiments, the expansion of the horizontal support assembly 430 also automatically causes each of the horizontal containment bar 518, pipe re-spooler assembly 342 and coupling assembly 520 to also expand such that the length of each of the horizontal containment bar 518, pipe re-spooler assembly 342 and coupling assembly 520 is increased until the width W+Y of the coil deployment trailer frame 500 is achieved. In one or more embodiments, one or more of the horizontal containment bar 518, pipe re-spooler assembly 342 and coupling assembly 520 may contain actuators, as described herein, that operate in conjunction with the actuators included in the horizontal support assembly 430. In one or more other embodiments, each of the horizontal containment bar 518, pipe re-spooler assembly 342 and coupling assembly 520 are void of actuators and are configured to expand or retract in response to the expansion or retraction of the horizontal support assembly 430. In one or more other embodiments, one or more of the horizontal support assembly 430, horizontal containment bar 518, pipe re-spooler assembly 342 and coupling assembly 520 are configured to be manually adjustable such that a user may manually increase or decrease the length thereof such that the coil deployment trailer frame 500 can change its width W to a new width.

Similar to the coil deployment trailer frame 300, one or more embodiments of the coil deployment trailer frame 500 is configured such that an operator of the coil deployment system can automatically configure the coil deployment trailer frame 500 to accommodate a coil 60 of spoolable pipe 12 of a predetermined width by inputting the width of the coil 60 into the controller which, in turn, will control the actuators to manipulate the frame components to achieve the desired configuration such that the coil 60 of spoolable pipe can be mounted to or unmounted from the coil deployment trailer frame 500. In these embodiments, each of the actuators, that operate to extend the male and female telescoping components included in the horizontal support assembly 430, are controlled to extend or retract, as described herein, such that a width of the trailer assembly that is suitable to accommodate the expandable drum assembly 301 is achieved. In one or more embodiments, actuators in one or more of the horizontal containment bar 518, pipe re-spooler assembly 342 and coupling assembly 520 are also controlled to extend or retract, as described herein, such that a width of the coil deployment trailer frame 500 that is suitable to accommodate the expandable drum assembly 301 is achieved. In other embodiments, once an operator inputs the desired width of the coil deployment trailer frame 500 into the controller, the male and female telescoping components included in each of the horizontal containment bar 518, pipe re-spooler assembly 342 and coupling assembly 520 are free to move with respect to another, as discussed herein, to obtain the proper length, respectively, in response to the axial expansion or contraction of the horizontal support assembly 430.

Figure 9:
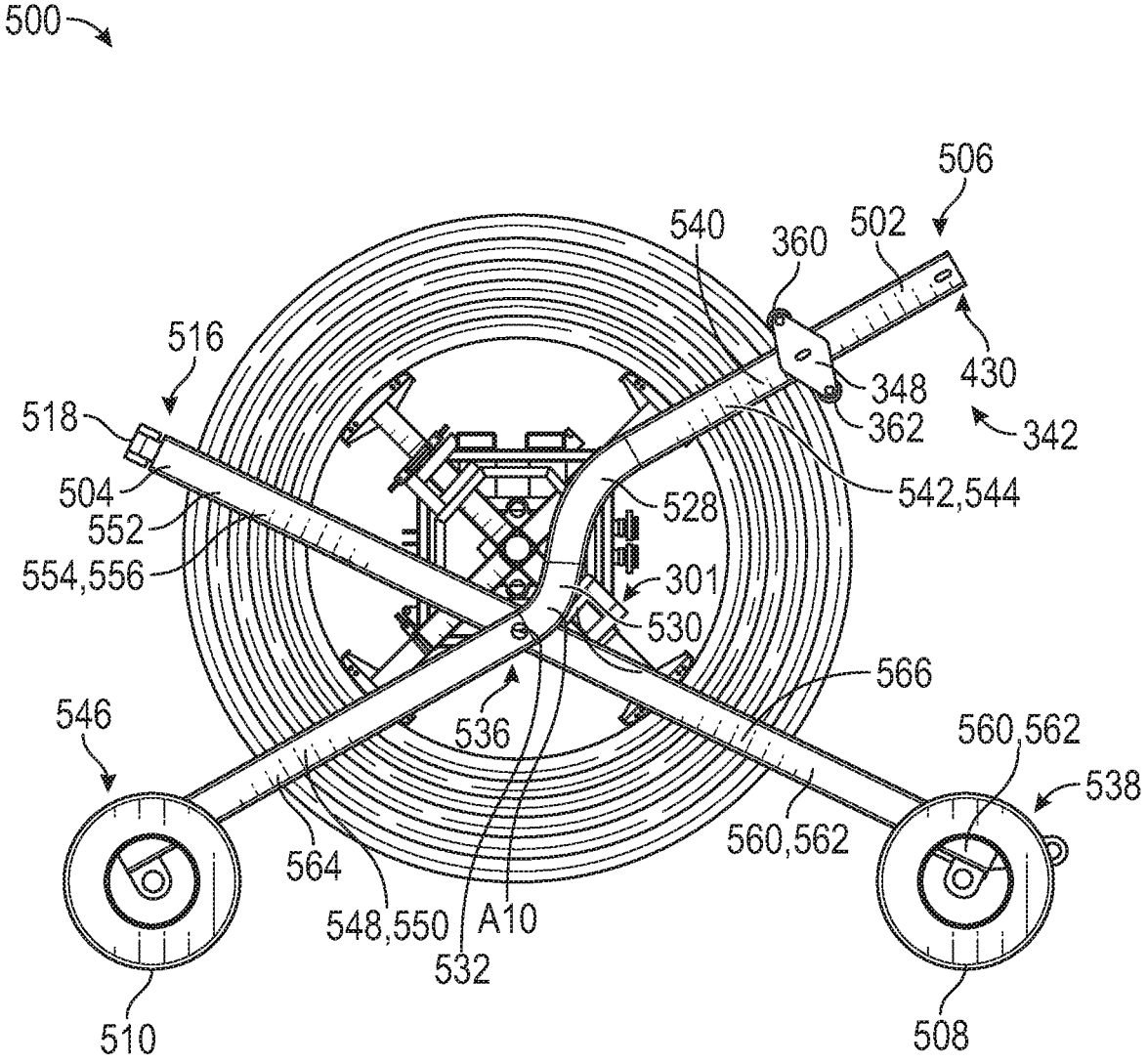
FIG. 9. is a side view of a trailer frame with a drum assembly loaded with a coil of pipe mounted on the trailer frame according to one or more embodiments of the present invention.

FIG. 9 illustrates a side view of one or more embodiments of the coil deployment trailer frame 500. As shown in FIG. 9, the first pair of trailer frame support arms 502 and the second pair of trailer frame support arms 504 have been positioned such that the expandable drum assembly 301 is lifted to a position that enables an operator of the coil deployment system to manipulate the coil deployment trailer frame 500 (e.g., to deploy, collect, store and/or transport the coil 60 of spoolable pipe 12 disposed on the expandable drum assembly 301). Thus, in one or more embodiments wherein the first pair of trailer frame support arms 502 and the second pair of trailer frame support arms 504 do not have the ability to telescopically expand or retract (i.e., the first and second pair of trailer support arms 502,04 are of a fixed length), the angular position of the first pair of trailer frame support arms 502 with respect to the second pair of trailer frame support arms 504 has been set such that a desired height of the coil deployment trailer frame 500 has been achieved. In one or more embodiments, an operator of the coil deployment system can automatically configure the coil deployment trailer frame 500 to achieve a predetermined height by inputting one of a desired height of the coil deployment trailer frame 500, the desired height of the coil 60 or the dimensions of the coil 60 to be deployed by the coil deployment trailer frame 500 into the controller. Once the requisite data is input into the coil deployment system, the controller will, in turn, activate the actuators, such as a pair of hydraulic cylinders, that are similar to the hydraulic cylinders 480 discussed with respect to the coil deployment trailer frame 500 (not shown), disposed between the first pair of trailer support arms 502 and the second pair of trailer support arms 504, to change the angular position of the of the first pair of trailer frame support arms 502 with respect to the second pair of trailer frame support arms 504 to achieve the desired height of the coil deployment trailer frame 500. In one or more other embodiments, the coil deployment trailer frame 500 can be configured such that one or more of the frame components can be manipulated manually such that the coil deployment trailer frame 500 can achieve a desired height and/or width.

In one or more embodiments, as discussed herein, one or more of the frame components, included in the coil deployment trailer frame 500, can be configured such that the frame component(s) can be telescopically extended using one or more actuators, as described herein. In one or more of these embodiments, actuators, that include one or more hydraulic actuators, pneumatic actuators, electric actuators, electro-magnetic actuators or a combination of hydraulic, pneumatic, electro-magnetic and/or electric actuators that are configured to engage one or more of the telescoping frame components included in the coil deployment trailer frame 500, can be utilized as described herein to extend or contract the frame component(s) such that the desired width and/or height of the coil deployment trailer frame 500 can be achieved.

Figure 10:
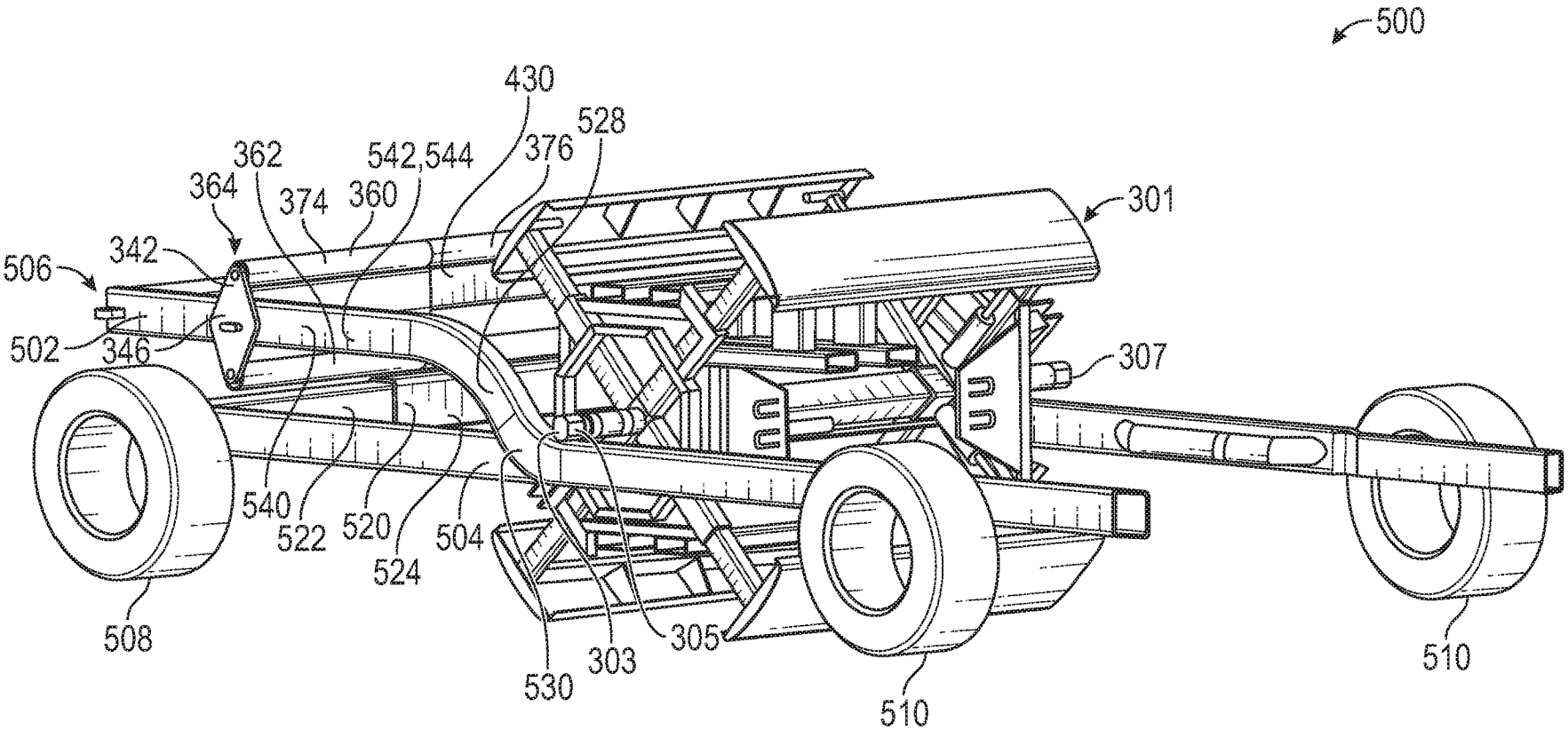
FIG. 10 is a perspective view of a collapsed trailer frame with a drum assembly loaded on the trailer frame according to one or more embodiments of the present invention.

FIG. 10 illustrates one or more embodiments of the coil deployment trailer frame 500 in a collapsed position. The coil deployment trailer system that includes the coil deployment trailer frame 500 can be utilized to manipulate the expandable drum assembly 301 to thereby lower the expandable drum assembly 301 using one of the means described herein (e.g., manual manipulation, actuator(s), controller(s), combination of one or more), depending upon the configuration of the coil deployment trailer system and the coil deployment trailer frame 500 included therein, to position the empty expandable drum assembly 301, loaded on the coil deployment trailer frame 500, at or near a ground surface to secure the expandable drum assembly 301. The coil deployment trailer system that includes the coil deployment trailer frame 500 can also be utilized to lower the coil 60 of spoolable pipe to a position above the ground, as is illustrated in FIGS. 17-19, to collect or dispense a coil of spoolable pipe on or from the expandable drum assembly 301, as described herein. In one or more embodiments, actuators that include one or more hydraulic actuators, pneumatic actuators, electric actuators, electro-magnetic actuators or a combination of hydraulic, pneumatic, electro-magnetic and/or electric actuators that are configured to engage one or more frame components included in the coil deployment trailer frame 500 can be utilized to lower and raise the coil deployment trailer frame 500 to a height that is suitable for securely and interlockingly mounting the expandable drum assembly 301 on the coil deployment trailer frame 500, as disclosed herein. In one or more embodiments, once the expandable drum assembly 301 is securely mounted upon the coil deployment trailer frame 500, the actuators can be utilized to lower and raise the expandable drum assembly 301 or the coil of spoolable pipe 12 disposed on the expandable drum assembly 301 to a height such that the spoolable pipe 12 can be securely stored upon, collected to or dispensed from the expandable drum assembly 301.

One having skill in the art having the benefit of the teachings described herein appreciates that one or more embodiments of the coil deployment trailer system can also be utilized to store, transport, manipulate, translate, collect and deploy various sizes of coils 60 of spoolable pipe 12 that are disposed on a reel or other drum assembly and utilizes one or more hub assemblies that are configured to engage the support brackets 302 included in the coil deployment trailer frame 300, as described herein. Similarly, one having skill in the art having the benefit of the teachings described herein appreciates that one or more embodiments of the coil deployment trailer system can also be utilized to store, transport, manipulate, translate, collect and deploy various sizes of coils 60 of spoolable pipe 12 that are disposed on a reel or other drum assembly that utilizes one or more hub assemblies that are configured to engage the hub engagement sections 536 included in the coil deployment trailer frame 500, as described herein. For example, one having skill in the art having the benefit of the teachings described herein appreciates that one or more embodiments of the coil deployment trailer system can also be utilized to store, transport, manipulate, translate, collect and deploy various sizes of coils 60 of spoolable pipe 12 that are disposed on the reel 44, described with respect to FIG. 5B. In one or more embodiments, the reel 44 can be mounted on the coil deployment trailer 300 to store, transport, manipulate, translate, collect and deploy various sizes of coils 60 of spoolable pipe 12 in a similar manner as described herein with respect to the expandable drum assembly 301. In one or more other embodiments, the reel 44 can be mounted on the coil deployment trailer 500 to store, transport, manipulate, translate, collect and deploy various sizes of coils 60 of spoolable pipe 12 in a similar manner as described herein with respect to the expandable drum assembly 301.

With respect to embodiments disclosed herein that are directed to the coil deployment trailer system that includes the coil deployment trailer frame 500, one having skill in the art with the benefit of the teachings provided herein will appreciate that the coil deployment trailer system that includes the coil deployment trailer frame 500 described herein will operate in a similar fashion to the one or more embodiments of the coil deployment trailer system that includes the coil deployment trailer frame 300 described herein. Accordingly, the scope of the disclosure should be limited only by the attached claims.

I claim:

1. A coil deployment system, the coil deployment system comprising:

a coil deployment trailer, the coil deployment trailer comprising:

a first support bracket configured to interlockingly and rotatably receive a first hub shaft of a coil drum;

a second support bracket that is spaced apart from the first support bracket and configured to interlockingly and rotatably receive a second hub shaft of the coil drum;

a first horizontal support bar including a pair of telescoping extension arms;

a first lower support arm having a first end pivotably connected to the first support bracket and a second end connected to the first horizontal support bar;

a second lower support arm having a first end pivotably connected to the second support bracket and a second end connected to the first horizontal support bar;

a third lower support arm having a first end pivotably connected to the first support bracket, and a second end, and a fourth lower support arm having a first end pivotably connected to the second support bracket, and a second end, wherein the width of the trailer is adjustable by moving the pair of telescoping extension arms relative to one another to adjust the length of the horizontal support bar.

2. The coil deployment system of claim 1, wherein the coil deployment trailer further comprises:

a first set of wheels mounted on the first lower support arm;

a second set of wheels mounted on the second lower support arm;

a third set of wheels mounted the third lower support arm; and and fourth set of wheels mounted on the fourth lower support arm, wherein each of the first, second, third and fourth set of wheels has an axis generally parallel to the first horizontal support bar and is configured to engage a ground surface to provide support and positioning for the coil deployment trailer.

3. The coil deployment system of claim 2, wherein the coil deployment trailer further comprises:

a fifth set of wheels mounted on the first lower support arm between the first set of wheels and the first end of the first lower support arm;

a sixth set of wheels mounted on the second lower support arm between the second set of wheels and the first end of the second lower support arm;

a seventh set of wheels mounted on the third lower support arm between the third set of wheels and the first end of the third lower support arm; and an eighth set of wheels mounted on the fourth lower support arm between the fourth set of wheels and the first end of the fourth lower support arm.

4. The coil deployment system of claim 3, wherein each of the first lower support arm, second lower support arm, third lower support arm and fourth lower support arm further comprises a pair of telescoping bars, wherein the height of the trailer is adjustable by moving each pair of telescoping extension arms relative to one another to adjust the length of the first lower support arm, second lower support arm, third lower support arm and fourth lower support arm.

5. The coil deployment system of claim 4, wherein each of the fifth set of wheels, sixth set of wheels, seventh set of wheels and eighth set of wheels is configured to engage the ground surface and provide support and positioning to the trailer when the height of the trailer is reduced to a collapsed position.

6. The coil deployment system of claim 3, wherein each of the fifth set of wheels, sixth set of wheels, seventh set of wheels and eighth set of wheels has an axis that is generally perpendicular to the axis of the first set of wheels.

7. The coil deployment system of claim 1, wherein the coil deployment trailer further includes a second horizontal support bar that comprises a second pair of telescoping extension arms, and wherein the width of the trailer is adjustable by moving the second pair of telescoping extension arms relative to one another to adjust the length of the second horizontal support bar in concert with the pair of telescoping extension arms included in the first horizontal support bar.

8. The coil deployment system of claim 1, wherein the coil deployment trailer further comprises:

a coupling assembly support bar including a pair of telescoping bars; and a first upper support arm having a first end connected to the coupling assembly support bar and a second end pivotably connected to the first support bracket; and a second upper support arm having a first end connected to the coupling assembly support bar and a second end pivotably connected to the second support bracket;

wherein the width of the trailer is adjustable by moving the pair of telescoping bars included in the coupling assembly support bar relative to one another to adjust the length of the coupling assembly support bar in response to adjusting the length of the first horizontal support bar.

9. The coil deployment system of claim 8, wherein the coil deployment trailer further comprises a pipe re-spooler mounted to the first upper support arm and second upper support arm, wherein the pipe re-spooler comprises:

a first re-spooler bracket mounted to the first upper support arm;

a second re-spooler bracket mounted to the second upper support arm;

a first substantially cylindrical member having a first end and a second end, wherein the first substantially cylindrical member extends between and is rotatably mounted to the first re-spooler bracket at the first end and the second re-spooler bracket at the second end; and wherein the first substantially cylindrical member is configured to engage a coil of spoolable pipe to assist in at least one of a deployment and collection of the spoolable pipe.

10. The coil deployment system of claim 9, wherein the pipe re-spooler further comprises:

a second substantially cylindrical member having a first end and a second end, wherein the second substantially cylindrical member extends between and is rotatably mounted to the first re-spooler bracket at the first end and the second re-spooler bracket at the second end; and wherein the second substantially cylindrical member is configured to engage the coil of spoolable pipe to assist in at least one of the deployment and collection of the spoolable pipe.

11. The coil deployment system of claim 10, wherein each of the first and second substantially cylindrical members further comprises a pair of telescoping bars, and wherein the length of the first and second substantially cylindrical members is adjustable by moving the pair of telescoping bars, included in each of the first and second substantially cylindrical members, relative to one another in response to adjusting the length of the first horizontal support bar.

12. The coil deployment system of claim 1, wherein the coil deployment trailer further comprises:

a horizontal containment bar including a pair of telescoping bars, wherein each of the telescoping bars includes an outer end; and a third upper support arm having a first end, connected to the horizontal containment bar, and a second end pivotably connected to the first support bracket; and a fourth upper support arm having a first end, connected to the horizontal containment bar, and a second end pivotably connected to the second support bracket;

wherein the length of the horizontal containment bar is adjustable by moving the pair of telescoping bars, included in the horizontal containment bar, in response to adjusting the length of the first horizontal support bar.

13. The coil deployment system of claim 1, wherein each of the first lower support arm, second lower support arm, third lower support arm and fourth lower support arm further comprises a pair of telescoping bars, and wherein the height of the trailer is adjustable by moving the first end and the second end of each of the first lower support arm, second lower support arm, third lower support arm and fourth lower support arm in a radial direction with respect to one another by slidably adjusting the pair of telescoping bars included in the first lower support arm, second lower support arm, third lower support arm and fourth lower support arm to adjust the length of each of the first lower support arm, second lower support arm, third lower support arm and fourth lower support arm.

14. The coil deployment system of claim 13, wherein each of the pairs of telescoping bars further includes one or more actuators that are configured to adjust the length of each of the first lower support arm, second lower support arm, third lower support arm and fourth lower support arm.

15. The coil deployment system of claim 1, wherein the one or more actuators include at least one of a hydraulic actuator, a pneumatic actuator, an electro-magnetic actuator, and an electrical actuator.

16. The coil deployment system of claim 1, wherein the coil deployment trailer further comprises:

a first hydraulic cylinder disposed between the first lower support arm and the third lower support arm;

a second hydraulic cylinder disposed between the second lower support arm and the fourth lower support arm;

wherein the first hydraulic cylinder is configured to move the first lower support arm with respect to the third lower support arm;

wherein the second hydraulic cylinder is configured to move the second lower support arm with respect to the fourth lower support arm; and wherein the height of the trailer is adjusted via actuation of one of the first and second hydraulic cylinders.

17. The coil deployment system of claim 1, wherein a controller is operable to automatically adjust the width and height of the trailer frame based upon data that includes one of the width and height of a coil of spoolable pipe.

18. A method of manipulating a coil deployment system, comprising:

providing a trailer frame comprising:

a first support bracket configured to interlockingly and rotatably receive a first hub shaft of a coil drum;

a second support bracket that is spaced apart from the first support bracket and configured to interlockingly and rotatably receive a second hub shaft of the coil drum;

a horizontal support bar including a pair of telescoping extension arms;

a first lower support arm having a first end pivotably connected to the first support bracket, and a second end connected to the horizontal support bar;

a second lower support arm having a first end pivotably connected to the second support bracket, and a second end connected to the horizontal support bar;

a third lower support arm having a first end, pivotably connected to the first support bracket, and a second end; and a fourth lower support arm having a first end, pivotably connected to the second support bracket, and a second end; and adjusting the width of the trailer frame by moving the pair of telescoping extension arms relative to one another to adjust the length of the horizontal support bar.

19. The method of claim 18, wherein the first lower support arm further includes interconnected telescoping arms, wherein the second lower support arm further includes interconnected telescoping arms, wherein the third lower support arm further includes interconnected telescoping arms, and wherein the fourth lower support arm further includes interconnected telescoping arms, and adjusting the height of the trailer frame by moving the interconnected telescoping arms included in the first, second, third and fourth support arms to adjust the length of the first, second, third and fourth support arms.

20. The method of claim 18, wherein the trailer frame further comprises:

a first set of wheels mounted on the first lower support arm;

a second set of wheels mounted on the second lower support arm;

a third set of wheels mounted on the third lower support arm;

a fourth set of wheels mounted on the fourth lower support arm;

a fifth set of wheels mounted on the first lower support arm, between the first set of wheels and the first end of the first lower support arm;

a sixth set of wheels mounted on the second lower support arm, between the second set of wheels and the first end of the second lower support arm;

a seventh set of wheels mounted on the third lower support arm, between the third set of wheels and the first end of the third lower support arm; and an eighth set of wheels mounted on the fourth lower support arm, between the fourth set of wheels and the first end of the fourth lower support arm;

wherein each of the first, second third and fourth set of wheels has an axis generally parallel to the horizontal support bar; and wherein each of the fifth, sixth, seventh and eighth set of wheels has an axis generally perpendicular to the first and second set of wheels;

maneuvering the trailer frame across a ground surface by rolling the trailer frame using the first, second, third and fourth set of wheels when the trailer is in a raised configuration; and maneuvering the trailer frame across a ground surface by rolling the trailer frame using the fifth, sixth, seventh and eighth set of wheels when the trailer is in a collapsed configuration.

* * * * *